United States Patent [19]

McHenry et al.

[11] Patent Number: 4,667,454

[45] Date of Patent: May 26, 1987

[54] METHOD OF OBTAINING ACCEPTABLE CONFIGURATION OF A PLASTIC CONTAINER AFTER THERMAL FOOD STERILIZATION PROCESS

[75] Inventors: Robert J. McHenry, St. Charles; Joseph B. Brito, Wildwood; Wilson T. Piatt, Jr., Sugar Grove, all of Ill.; Robert J. Reed, Jackson, Miss.; Krishnaraju Varadarajan, Hoffman Estates, Ill.; Kenneth B. Spencer, Barrington, Ill.; Boh C. Tsai, Rolling Meadows, Ill.; Mark A. Williams, Schaumburg, Ill.; Donald C. Vosti, Crystal Lake, Ill.; James A. Wachtel, Buffalo Grove, Ill.

[73] Assignee: American Can Company, Greenwich, Conn.

[21] Appl. No.: 627,703

[22] Filed: Jul. 3, 1984

Related U.S. Application Data

[63] Continuation-in-part of Ser. No. 455,865, Jan. 5, 1982.

[51] Int. Cl.[4] ..... B65B 55/02; B65B 55/14

[52] U.S. Cl. ..... 53/425; 53/440

[58] Field of Search ..... 53/289, 425, 433, 440, 53/442, 469, 486; 426/401, 407

[56] References Cited

U.S. PATENT DOCUMENTS

| | | | |
|---|---|---|---|
| 2,894,844 | 7/1959 | Shakeman | 220/70 X |
| 3,400,853 | 9/1968 | Jacobsen | 220/66 |
| 3,409,167 | 11/1968 | Blanchard | 220/66 |
| 3,492,773 | 2/1970 | Bergstrom | 53/433 |
| 3,977,153 | 8/1976 | Schrenk | 53/453 |
| 4,381,061 | 4/1983 | Cerney et al. | 220/70 X |

FOREIGN PATENT DOCUMENTS

| | | |
|---|---|---|
| 0039377 | 11/1981 | European Pat. Off. . |
| 1061643 | 7/1959 | Fed. Rep. of Germany . |
| 2105450 | 2/1971 | Fed. Rep. of Germany . |
| 403605 | 6/1966 | Switzerland . |
| 1235060 | 6/1971 | United Kingdom . |
| 1284805 | 8/1972 | United Kingdom . |
| 1341126 | 12/1973 | United Kingdom . |
| 1600801 | 10/1981 | United Kingdom . |

OTHER PUBLICATIONS

Dow Chemical Co., Letters from J. I. Barbier to J. A. Wachtel, dated Jul. 28, Aug. 11, 1978.

"Plastics Containers for Perishable Foods"—LWT Report, pp. 386–391, B. I. Turtle, from a lecture at International Conference on the Prevention of Spiolage Through Packaging, Jun. 9–11, 1976, Munich, Germany.

*Primary Examiner*—E. Michael Combs

*Attorney, Agent, or Firm*—Paul R. Audet

[57] ABSTRACT

A method is provided for obtaining an acceptable configuration of a thermally processed container packed with food. Improvement in container configuration is attained by proper container design, by maintaining proper headspace of gases in the container during thermal processing, proper pressure outside the container during the cooking cycle and cooling cycle of the process and/or by controlled reforming of the bottom wall of the container. Further improvements are attained by controlling the thermal history of the empty container, such as by pre-shrinking the container before it is filled with food and sealed.

68 Claims, 20 Drawing Figures

THICKNESS PROFILE (MILS)

| | |
|---|---|
| $T_1$ | 25 |
| $T_2$ | 31 |
| $T_3$ | 38 |
| $T_4$ | 33 |
| $T_5$ | 15 |
| $T_6$ | 16 |
| $T_7$ | 27 |

METHOD OF OBTAINING ACCEPTABLE CONFIGURATION OF A PLASTIC CONTAINER AFTER THERMAL FOOD STERILIZATION PROCESS

RELATED APPLICATIONS

This application is continuation-in-part of application Ser. No. 455,865, filed on Jan. 5, 1982.

FIELD OF INVENTION

This invention generally relates to containers used for packaging foods and, in one aspect, it relates to a method of improving the configuration of packed plastic containers after thermal processing of the container and its content. In another aspect, the present invention is concerned with attaining acceptable configuration of such containers after thermal processing. In still another aspect, the present invention relates to proper design of plastic containers to improve their configuration after thermal processing.

BACKGROUND OF THE INVENTION

It is common knowledge in the food packaging industry that after a container is filled with certain foods and is closed, the container and its content must be thermally processed to sterilize the food so that it will be safe for human consumption.

Thermal processing of such containers is normally carried out at temperatures higher than about 190° F. in various equipment such as rotary continuous cookers, still retorts and the like, and the containers are subjected to various cook-cool cycles before they are discharged, stacked and packed for shipment and distribution. Under these thermal processing conditions, plastic containers tend to become distorted or deformed due to sidewall panelling (buckling of the container sidewall), and/or distortion of the container bottom wall, sometimes referred to as "bulging" or "rocker bottom". These deformations and distortions are unsightly, and interfere with proper stacking of the containers during their shipment, and also cause them to rock and to be unstable when placed on counters or table tops. In addition, bottom bulging is, at times, considered to be a possible indication of spoilage of the food thus resulting in the rejection of such containers by consumers.

One reason for the distortion of the container is that during thermal processing the pressure within the container exceeds the external pressure, i.e., the pressure in the equipment in which such process is carried out. One solution to this problem is to assure that the external pressure always exceeds the internal pressure. The conventional means of achieving this condition is to process the filled container in a water medium with an overpressure of air sufficient to compensate for the internal pressure. This is the means used to process foods packed in glass jars and in the well-known "retort pouch". The chief disadvantage of this solution is that heat transfer in a water medium is not as efficient as heat transfer in a steam atmosphere. If one attempts to increase the external pressure in a steam retort by adding air to the steam, the heat transfer efficiency will also be reduced relative to that in pure steam.

Several factors contribute to the increase in internal pressure within the container. After the container is filled with food and hermetically closed, as a practical matter, a small amount of air or other gases will be present in the headspace above the food level in the container. This headspace of air or gas is present even when the container is sealed under partial vacuum, in the presence of steam (flushing the container top with steam prior to closing) or under hot fill conditions (190° F.). When the container is heated during thermal processing, the headspace gases undergo significant increases in volume and pressure. Additional internal pressures will also develop due to thermal expansion of the product, increased vapor pressures of the products, the dissolved gases present within the product and the gases generated by chemical reactions in the product during its cooking cycle. Thus, the total internal pressure within the container during thermal processing is the sum total of all of the aforementioned pressures. When this pressure exceeds the external pressure, the container will be distorted outwardly tending to expand the gases in the headspace thereby reducing the pressure differential. When the container is being cooled, the pressure within the container will decrease. Consequently, the sidewall and/or the bottom wall of the container will be distended inwardly to compensate for the reduction in pressure.

It has been generally observed that such thermally processed plastic containers may remain distorted because of bulging in the bottom wall and/or sidewall panelling. Unless these deformities can be eliminated, or substantially reduced, such containers are unacceptable to consumers.

It must also be noted that it is possible to make a container from a highly rigid resin with sufficient thickness to withstand the pressures developed during thermal processing and thus alleviate the problems associated therewith. However, practical considerations and economy militate against the use of such containers for food packaging.

Accordingly, it is an object of this invention to improve the configuration of a plastic container after thermal processing.

It is another object of this invention to alleviate the problems associated with bottom bulging and sidewall panelling of a plastic container which result from thermal processing.

It is a further object of this invention to attain an acceptable container configuration after such container is packed with food, hermetically closed and thermally processed.

It is still another object of this invention to provide methods, and container configurations which permit plastic containers to have acceptable configurations despite their having been subjected to thermal food processing conditions.

It is yet another object of this invention to facilitate thermal food processing of plastic containers packed with food.

The foregoing and other objects, features and advantages of this invention will be further appreciated from the ensuing detailed description and the accompanying drawings.

SUMMARY OF THE INVENTION

In accordance with this invention, a method is provided for improving the configuration of thermally processed plastic containers which are packed with food. Objectionable distortions and deformations (i.e., rocker bottom and/or sidewall panelling) in the container are eliminated, or substantially reduced, by proper container design, by maintaining proper headspace of gases in the container during thermal processing, by maintaining proper relative pressure during the cooking cycle and cooling cycle of the process, by controlling reforming of the container bottom wall after thermal processing and/or by pre-shrinking the empty container prior to filling and sealing.

BRIEF DESCRIPTION OF THE DRAWINGS

In the drawings, wherein like numerals are employed to designate like parts.

DETAILED DESCRIPTION OF THE INVENTION

Figure 1A:
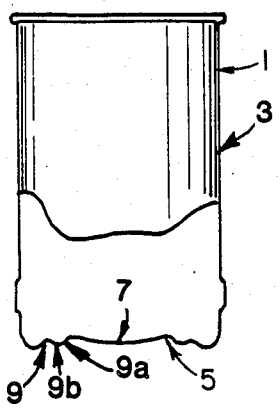
FIG. 1A is a front elevational view partly in section, of a cylindrical container of this invention before the container is packed with food and sealed.

In a typical operation involving food packaging, the plastic containers are filled with foods and each container is then hermetically sealed by a top closure. As it was previously mentioned, the container is typically either sealed under vacuum or in an atmosphere of steam created by hot-filling or by passing steam at the container top while sealing. As it was also mentioned previously, after the container is sealed, there invariably is a headspace of gases in the container. Next, the sealed container is thermally processed at a temperature which is usually about 190° F. or higher depending on the food, in order to sterilize the container and its content, and thereafter cooled to ambient temperature. After thermal processing and cooling, the containers are removed from the thermal processing equipment, stored and then shipped for distribution.

During the cooking cycle of the thermal sterilization process, the pressure within the container will rise due to increased pressure of headspace gases, the vapor pressure of the products, the dissolved gases in the products as well as the gases which may sometimes be generated from chemical reactions in the container's content, and due to thermal expansion of the product. The reversible thermal expansion of the container will tend to lower the pressure within the container; however, the net effect of all the factors will be an increase in pressure. Therefore, during the cook cycle, the pressure within the container will exceed the external pressure and, consequently, the container bottom wall will distend outwardly, i.e., it will bulge. As it was also previously mentioned, after thermal processing and cooling, the pressure within the container is decreased and the container bottom wall will flux inward to compensate for this reduction of pressure. Frequently, however, the container bottom does not fully return to an acceptable position or configuration and remains bulged to varying degrees.

The containers to which the present invention is well suited are plastic containers which are made of rigid or semi-rigid plastic materials wherein the container walls are preferably made of multilayer laminate structures. A typical laminate structure may consist of several layers of the following materials:

outer layer of polypropylene or a blend of polypropylene with high density polyethylene, adhesive layer, barrier layer such as ethylene-vinyl alcohol copolymer layer, adhesive layer, and an inner layer of polypropylene or a blend of polypropylene with high density polyethylene.

The adhesive is usually a graft copolymer of maleic anhydride and propylene wherein the maleic anhydride moieties are grafted onto the polypropylene chain.

It must be understood, however, that the nature of the different layers are not per se critical since the advantages of this invention can be realized for containers made of other plastic materials as well, including those having less or more than five layers, including single layer containers.

Referring now to the drawings, there is shown in FIG. 1A a plastic container 1 having sidewalls 3 and a bottom wall 5 which includes a substantially flat portion 7 and outer and inner convex annular rings 9 and 9a with an interstitial ring 9b.

Figure 1B:
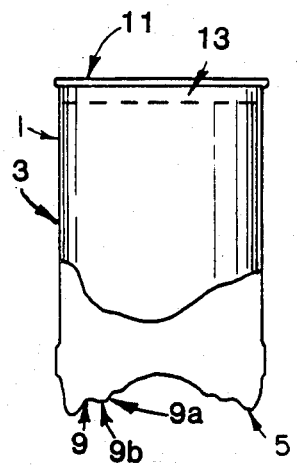
FIG. 1B is a front elevational view partly in section, of the container shown in FIG. 1A after the container has been filled with food and sealed under partial vacuum.

After the container is filled, it is sealed with a top closure 11 as shown in FIG. 1B. As it was previously mentioned, after the container is filled and sealed, there will be a headspace of gases at the container top generally designated as 13.

Figure 1C:
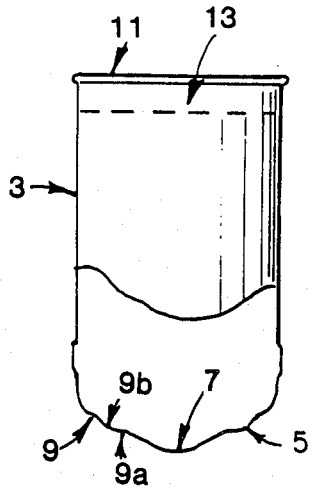
FIG. 1C is a front elevational view partly in section, of the container shown in FIG. 1B during thermal processing but before reforming, showing bulging of the container bottom wall.
Figure 1D:
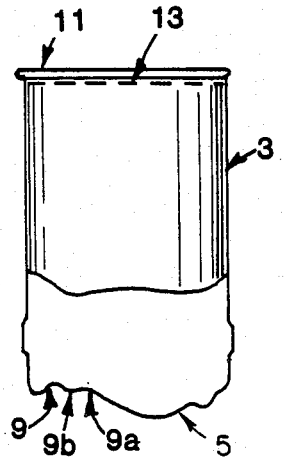
FIG. 1D is a front elevational view partly in section, of the container shown in FIG. 1C illustrating rocker bottom after thermal processing.
Figure 1E:
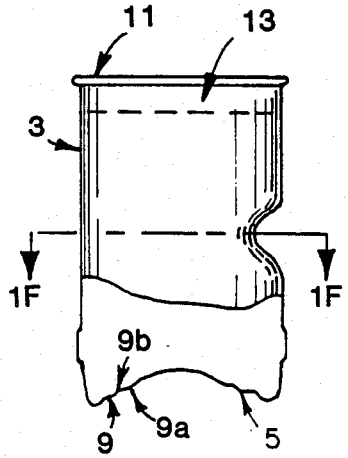
FIG. 1E is a front elevational view partly in section, of a container similar to FIG. 1D but wherein the container sidewalls are panelled.
Figure 1G:
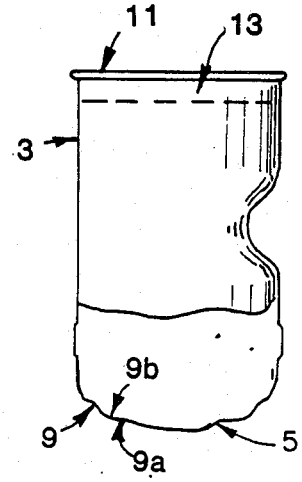
FIG. 1G is a front elevational view partly in section, of the container shown in FIG. 1A illustrating sidewall panelling and bottom bulging.
Figure 1H:
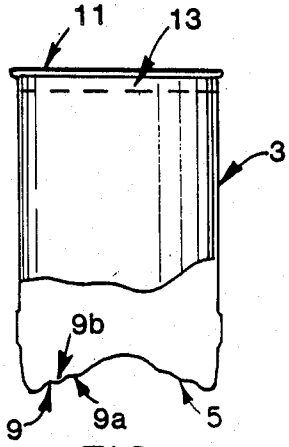
FIG. 1H is a front elevational view partly in section, of the container shown in FIG. 1A after thermal processing, according to the present invention.
Figure 1F:
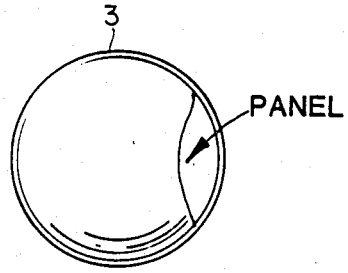
FIG. 1F is cross sectional view of the container taken along the line 1F—IF in FIG. 1E.

FIG. 1C shows the container 1 during thermal processing, or after thermal processing but before bottom reforming. As shown in this figure, the container bottom is outwardly distended because the pressure within the container exceeds the external pressure. If no proper prior measures are taken, after the container is cooled, the bottom wall may remain deformed as shown in FIG. 1D. Such container configuration is unstable or undesirable due to rocker bottom. As will hereinafter be explained, rocker bottoms (FIG. 1D) and sidewall panelling as shown in FIGS. 1E and 1F, or both (FIG. 1G), may be minimized or prevented by pre-shrinking the container prior to filling and closing, by reforming the container bottom wall, by adjusting the headspace of gases in the container at each vacuum level, by proper container design, by maintaining proper pressure differential between the inside and outside of the container, or by combination of these factors. FIG. 1H represents the desired container configuration after thermal processing and reforming of the container because it has no rocker bottom or sidewall panelling. This container configuration is the same or nearly the same as the configuration shown in FIG. 1B.

As it was previously mentioned, during the cooking cycle, the pressure within the container will rise due to the aforementioned factors, and the container bottom wall will be outwardly distended. Unless proper measures are taken, the container may burst due to excessive pressure in the container. The container must be designed to deform outwardly at a container internal pressure below the pressure which causes bursting of the container at the particular cooking temperature. For example, at 250° F., a temperature commonly used for sterilizing low acid foods (e.g., vegetables), the container will burst if the internal pressure of the container exceeds its external pressure by approximately 13 p.s.i. It will be understood, of course, that this pressure will be different at other cooking temperatures and for other container sizes and designs.

The amount of outward distention of the container bottom wall, and hence the volume increase in the container, during the cooking cycle, must be sufficient as to prevent bursting of the container by reducing the internal pressure. It has been found that this volume increase depends on several factors, such as, the initial vacuum level in the container headspace, the initial headspace, thermal expansion of the product and the container, the container design and its dimension. Table I below sets the volume change for a multi-layer injection blow molded container (303×406) at two different thermal processing conditions.

TABLE I

| Condition | Example A | Example B |
|---|---|---|
| Steam Temperature °F. | 230 | 240 |

TABLE I-continued

| Condition | Example A | Example B |
|---|---|---|
| Content Temperature at filling, °F. | 70 | 70 |
| Content av. temperature, end of cook, °F. | 225 | 235 |
| Max. inside metal end wall temp., °F. | 228 | 238 |
| Pressure at closing, psia | 6.7 | 6.7 |
| Internal Pressure assuming no bulge ($P_1$), psia | 27.4 | 32.6 |
| Internal Pressure after bulge ($P_2$), psia | 23.7 | 28.0 |
| Internal pressure minus External Pressure | | |
| Unbulged Container $P_1$ − 14.7, psi | 12.7 | 17.9 |
| Bulged Container $P_2$ − 14.7, psi | 9.0 | 13.3 |
| Burst Strength of container, psi at process temperature | 19 | 16 |
| Head Space Volume, | | |
| Initial Volume cu. in | 1.48 | 1.48 |
| Volume After Bulge, cu. in. | 3.10 | 3.11 |
| Volume Increase, cu. in. | 1.62 | 1.63 |

Example B of Table I illustrates that if the container does not bulge sufficiently to reduce the pressure differential to below 16 p.s.i. the container would burst. On the other hand, Example A represents conditions under which bottom bulging is not required to prevent bursting. It should be recognized that bursting of a container can occur through a failure of the sealing means as well as by a rupture of container wall. It should also be recognized that the decrease in pressure differential as a result of bottom bulging is beneficial even if the container would not burst at the higher pressure. Such a reduction in pressure differential will reduce the amount of "creep" or "permanent deformation" which the container will undergo during the thermal process. As will be discussed later, such creep makes it more difficult to reform the bottom wall later in the thermal process.

In order to attain the desired increase in volume of the container, it has been found that the container bottom wall must be so designed as to provide a significant deformation of the bottom wall of the container. Such bottom wall design is a significant consideration during the cook cycle and reforming as will hereafter be explained.

Figure 2:
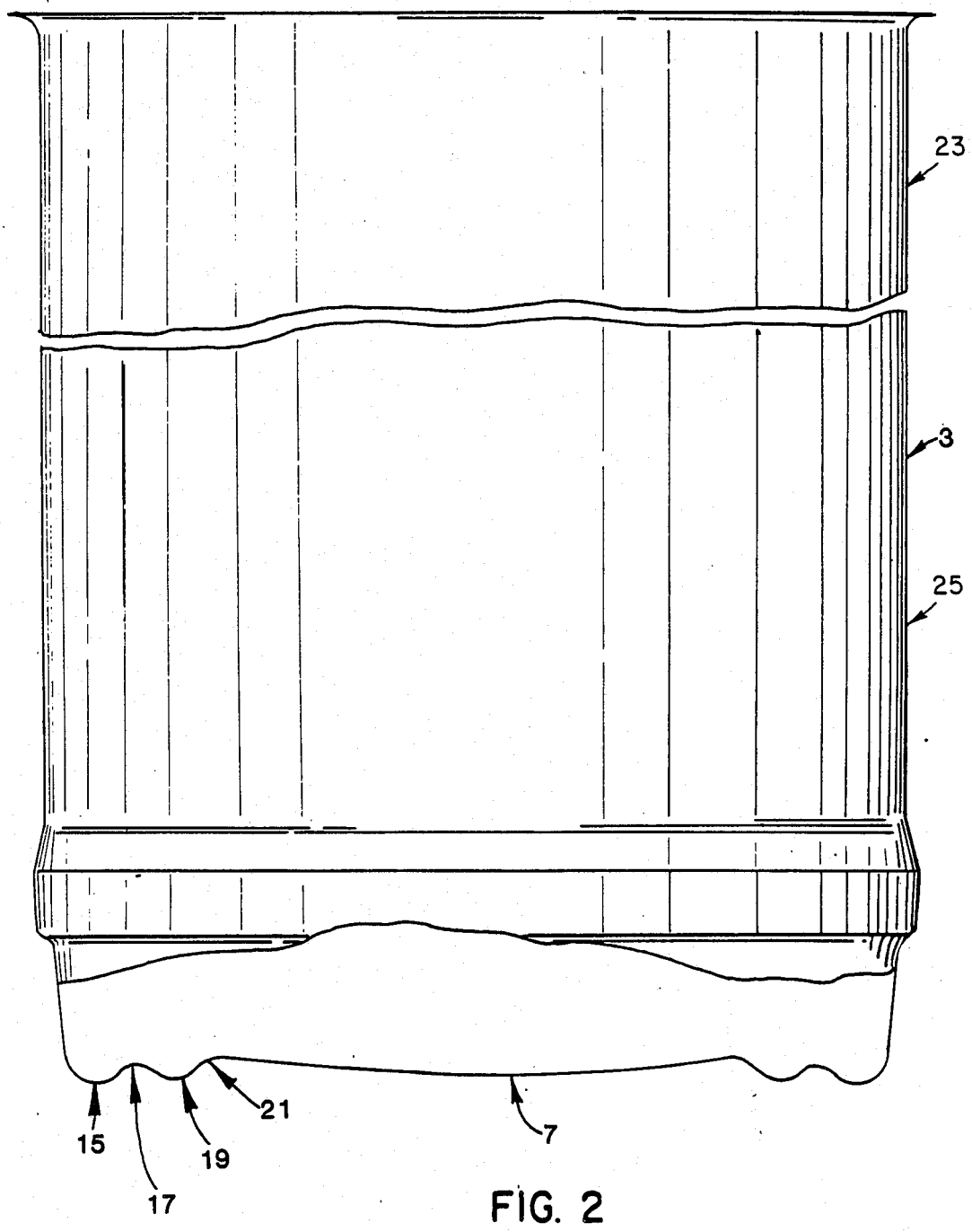
FIG. 2 is an enlarged vertical section schematically illustrating the cylindrical container of FIG. 1A.

It has been discovered that in order to accommodate the requirements of volume increase of the container without bursting during the cook cycle, and inward distention of the bottom wall on reform to attain an acceptable bottom configuration, the container must be appropriately designed. Thus, the container bottom wall must be so designed and configured as to include portions which have lower stress resistance relative to other portions of the bottom wall, as well as relative to the container sidewall. Such container configuration is shown in FIG. 2 wherein the bottom wall includes portions such as shown at 15, 17, 19 and 21 which are configured to have lower stress resistance than the portion of the bottom wall designated by 7, and the sidewalls as shown at 23 and 25.

Figure 3:
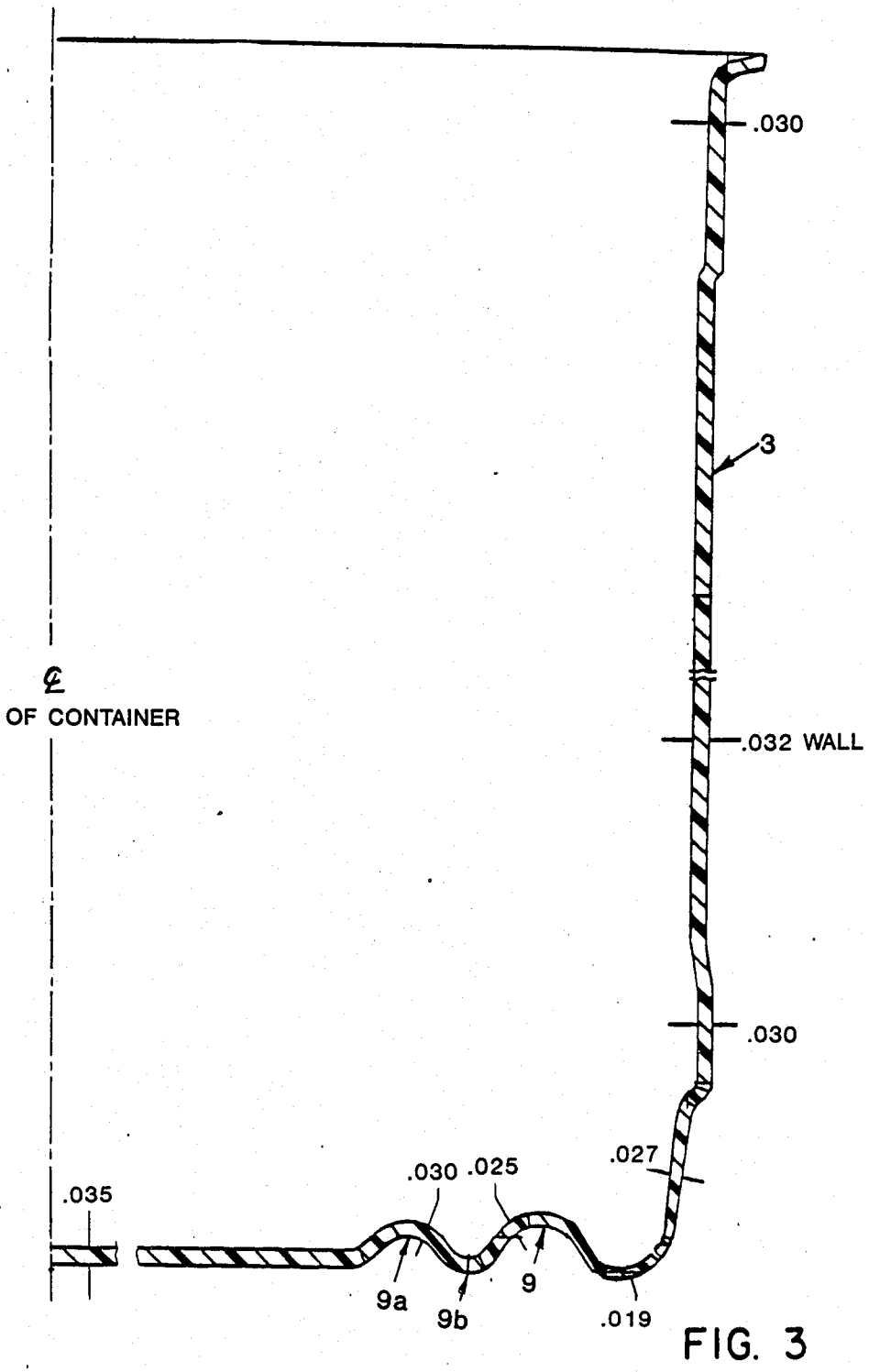
FIG. 3 is a partial elevational fragmentary sectional view of a multi-layer thermoformed container similar to that shown in FIG. 2, showing wall portions having different thicknesses.
Figure 4:
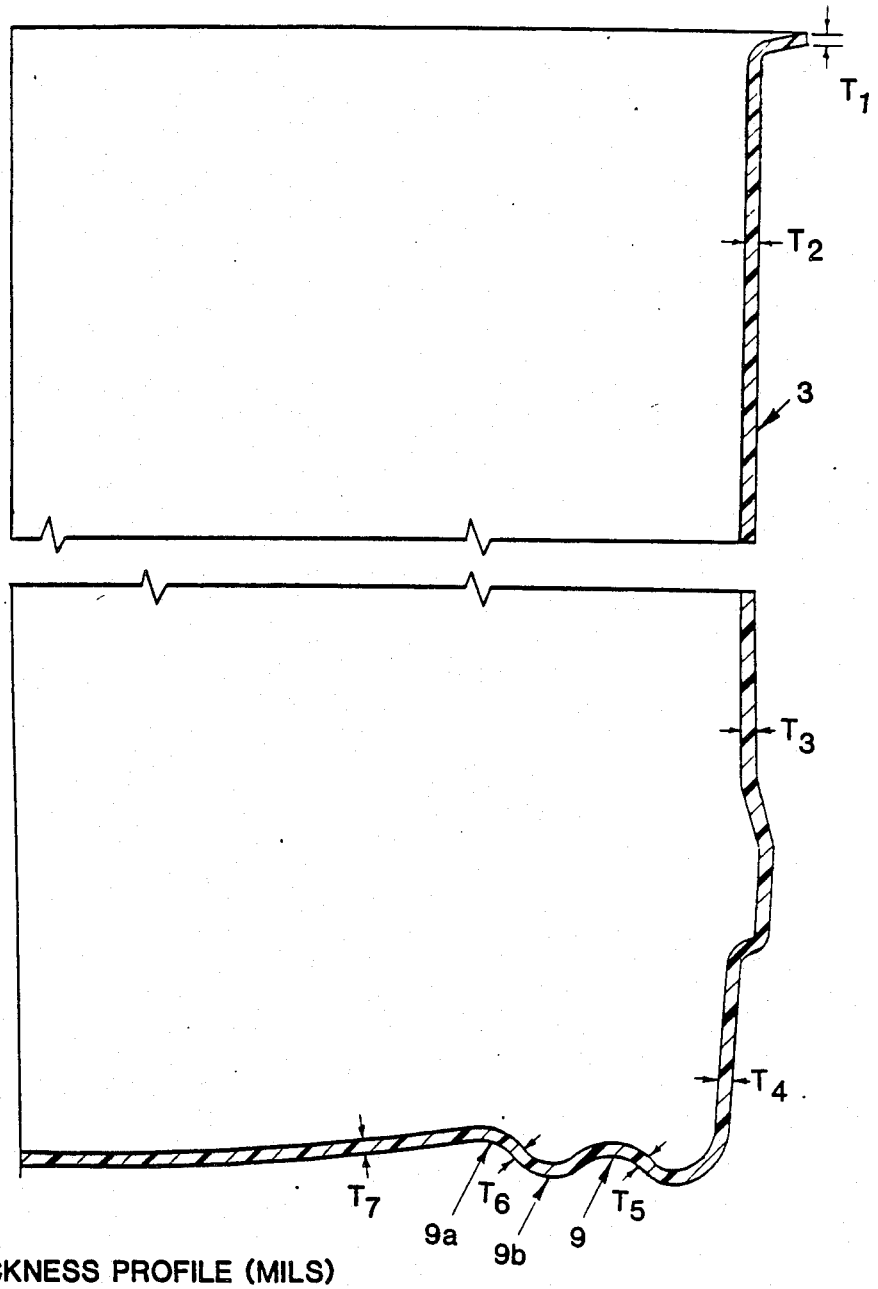
FIG. 4 is a partial elevational fragmentary sectional view of a multi-layer injection blow molded container similar to that shown in FIG. 2, showing wall portions having different thicknesses.
Figure 5:
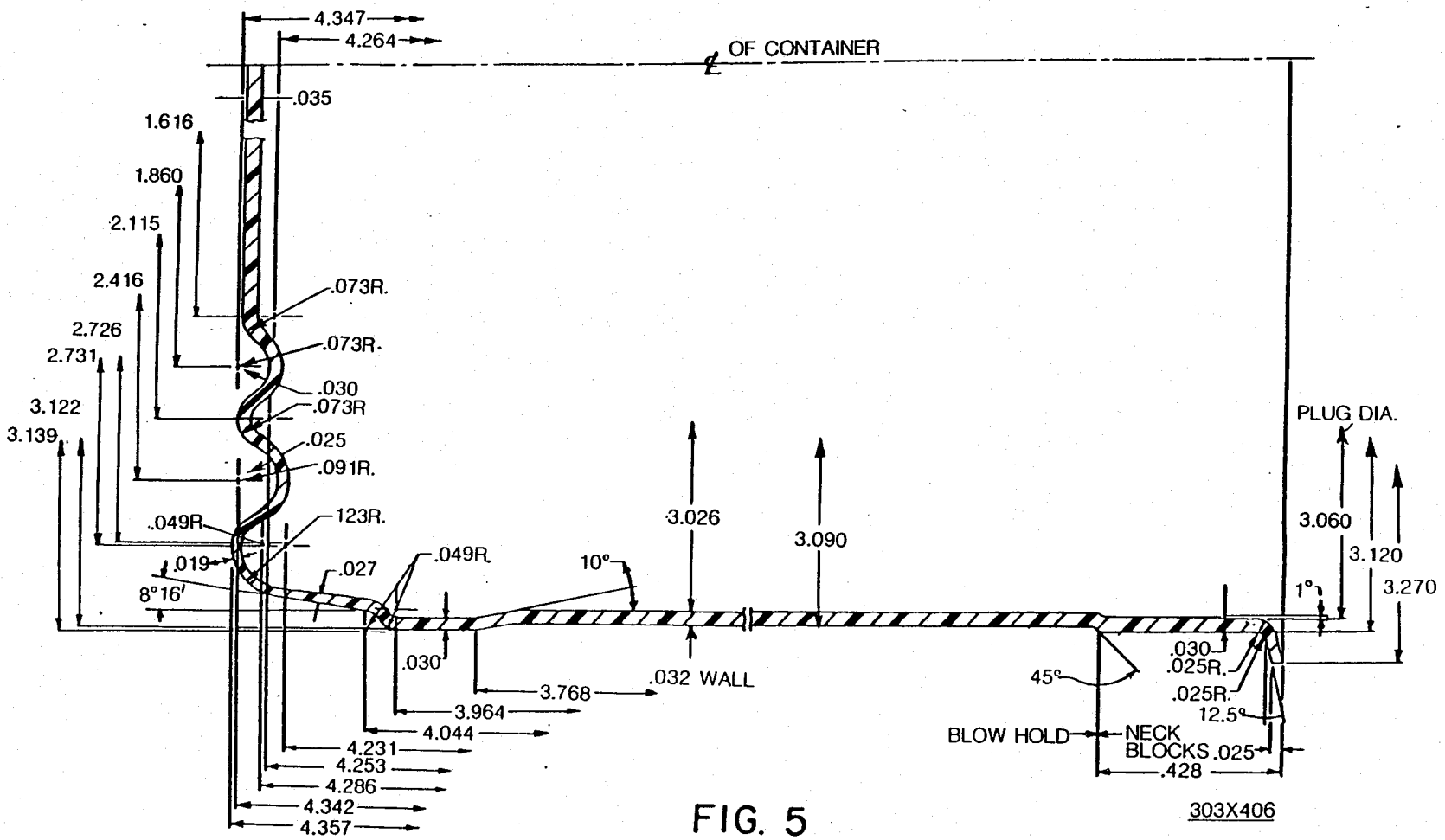
FIG. 5 is a partial elevational fragmentary sectional view of a container similar to FIG. 3 but showing the dimensions of a multi-layer thermoformed container.

Although the bottom wall of the container may be made to include portions of less stress resistance by varying the bottom configuration, such lower stress resistant areas can be formed by varying the material distributions of the container so that its bottom wall include weaker or thinner portions. Thus, as shown in FIG. 4, the thicknesses of the bottom wall at $T_5$ and $T_6$ are less than $T_7$, thickness of the remaining segment of the bottom wall. Similarly, $T_5$ and $T_6$ are less than $T_2$, $T_3$ and $T_4$, the thicknesses at different portions of the sidewall. Similar differences in material distribution are shown in FIG. 3.

Another example of a bottom configuration which includes portions of less stress resistance is one having segmented indented portions preferably equal, such as a cross configuration wherein the indented portions have less stress resistance than the remainder of the bottom wall e.g. remaining segments thereof, and than the container sidewall. Preferably the indented segments of the cross meet at the axial center of the bottom. Deeper indentations assist reformation, and while shallower ones help to prevent excess of bulging.

Figure 8:
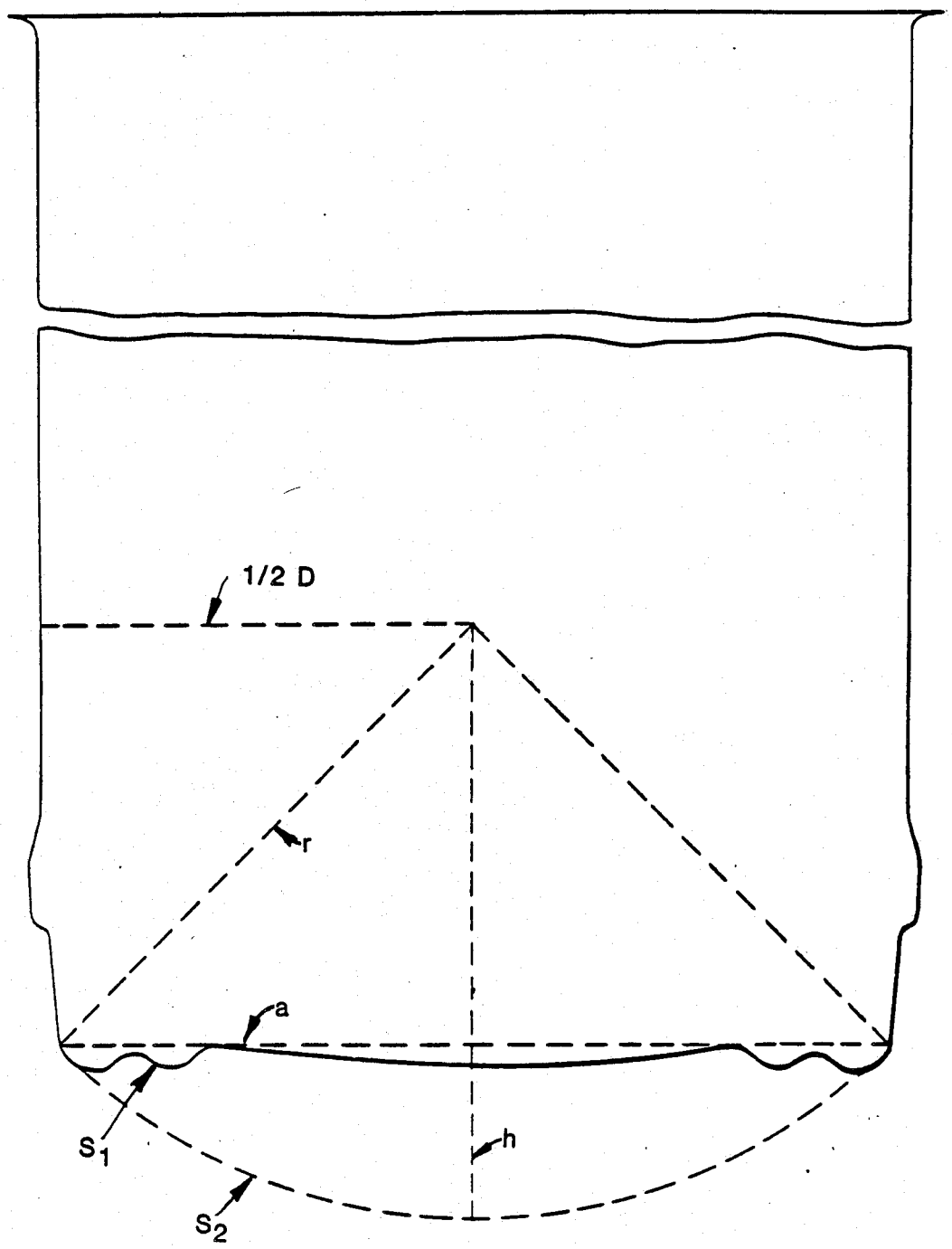
FIG. 8 is a schematic representation illustrating the container bottom wall geometry before and after bulging.

A large outward deformation of the container bottom wall is usually best achieved by unfolding of "excess" material in the container bottom rather than by simple stretching of the plastic wall. The preferred container bottom wall should therefore be designed so as to have approximately the same surface area as would a spherical cap whose volume is the sum of the undeformed volume of the bottom of the container plus the desired volume increase. The volume of the hemispherical cap shown in FIG. 8 can be determined from the equation (1) as follows:

$$V=1/6\pi h(3a^2+h^2) \quad (1)$$

where "V" is the volume, "h" is the height of the dome of the spherical cap and "a" is the radius of the container at the intersection of the sidewall and bottom wall of the container.

The surface of the spherical cap may be calculated from equation 2 as follows:

$$S_2=\pi(a^2+h^2)(4/3) \quad (2)$$

where "$S_2$" is the surface area of the spherical cap, and "a" and "h" are as discussed above.

The design volume and the surface area of the spherical cap required for satisfactory bulge and reform over a wide range of food processing conditions for a container of any given size (within a wide range of sizes) may be calculated by the following procedure:

The ratio of the "h" dimension to the "a" dimension is expressed as $$k=h/a$$

or $$h=ka$$

where "h" and "a" are as described above. It has been discovered that "k" is about 0.47 for satisfactory containers. Therefore the required volume and surface area of the spherical cap required for a satisfactory container of a given size may be calculated as follows:

$$V=1/6\pi(0.47)a(3a^2+(0.47a)^2)$$

$$S_2=\pi(a^2+(0.47a)^2)$$

where "$S_2$", "V", and "a" are as discussed above for the given size container.

The bottom is designed to have a surface "$S_1$", in the folded portion so that "$S_1$", is approximately equal to $S_2$ As it was previously explained, at the conclusion of the thermal sterilization cycle, the container bottom wall is distended outwardly and must therefore be reformed to attain an acceptable bottom configuration. The bulged bottom will not return to its original configuration merely by eliminating the pressure differential across the container wall. This failure to return to its original configuration is a result of "creep" or "permanent deformation" of the plastic material. Creep is a well-known property of many polymeric materials. The bottom wall can be reformed by imposing added external pressure, or reducing the internal pressure in the container, so that the pressure outside the container exceeds the pressure within the container. This reformation can best be effected while the bottom wall is at "reformable temperature". This temperature will of course vary depending on the nature of the plastic used to form the bottom wall but, for polyethylene-polypropylene blend, this temperature is about 112° F.

Reformation by imposing an "overpressure" can be readily attained by introducing air, nitrogen, or some other inert gas at the conclusion of thermal processing but before cooling. Where the contents can be degraded by oxidation, it is preferable to use nitrogen or another inert gas rather than oxygen since at the prevailing reform temperatures, the oxygen and moisture barrier properties of the plastic are reduced.

The advantages of adequate overpressure during reforming of the container bottom wall is illustrated in the following series of tests.

Several thermoformed plastic containers (401×408 i.e. 4 1/16 inches in diameter and 4 8/16 inches high) were filled with water to a gross headspace of 10/32 inch, closed at atmospheric conditions and thermally processed in a still retort under an atmosphere of steam at 240° F. for 15 minutes. At the conclusion of the thermal sterilization process, air was introduced into the retort to increase the pressure from 10 to 15 p.s.i.g. Thereafter, the container contents were cooled to 160° F. by introducing water into the retort. The resulting containers were observed to have severly bulged bottom and sidewall panelling.

The foregoing procedure was repeated for another set of identical thermoformed plastic containers under the same conditions except that the pressure during reform was increased to 25 p.s.i.g. prior to introducing the cooling water. The resulting containers had no rocker bottoms or sidewall panelling and the containers had an acceptable configuration. The results are shown in Table II below.

TABLE II

| Fill Temp., (F.) | COOKING CYCLE (1) Pressure (p.s.i.g.) | REFORM CYCLE (2) Pressure at 160 F. (p.s.i.g.) | CONTAINER CONFIGURATION Sidewall Panelling (3) | Bottom Bulge (4) | COMMENTS |
|---|---|---|---|---|---|
| 160 F. | 10 | 15 | Severe | Severe | All |
| 160 F. | 10 | 15 | Severe | Severe | Containers |
| 160 F. | 10 | 15 | Severe | Severe | Had |
| 175 F. | 10 | 15 | Severe | Severe | Objectionable |
| 175 F. | 10 | 15 | Severe | Severe | Configuration |

TABLE II-continued

| Fill Temp., (F.) | COOKING CYCLE (1) Pressure (p.s.i.g.) | REFORM CYCLE (2) Pressure at 160 F. (p.s.i.g.) | CONTAINER CONFIGURATION Sidewall Panelling (3) | Bottom Bulge (4) | COMMENTS |
|---|---|---|---|---|---|
| 175 F. | 10 | 15 | Severe | Severe | |
| 160 F. | 10 | 25 | OOR-1 | OK-125 | All |
| 160 F. | 10 | 25 | OOR-2 | OK-120 | Containers |
| 160 F. | 10 | 25 | OOR-1 | OK-145 | Had |
| 175 F. | 10 | 25 | OOR-1 | OK-245 | Acceptable |
| 175 F. | 10 | 25 | OOR-1 | OK-168 | Configuration |
| 175 F. | 10 | 25 | OOR-1 | OK-140 | |

(1) Steam cook at 240 F. maximum temperature.
(2) Air pressure durinng cooling maintained until container contents was cooled to 160° F.
(3) "OOR" designates out of roundness with OOR of 1 indicating almost perfect roundness and OOR of 5 indicating almost panelled.
(4) Numbers following OK measure center panel depth in mils. Thus OK-125 indicates inward bottom distention of ⅛ inch.

Thus, as illustrated in Table II, an adequate overpressure must be maintained during reform in order to obtain acceptable container configuration. From the above, it can be seen that "overpressure" herein means the retort cooling pressure is usually greater than the retort cooking pressure. Overpressure does not refer to the pressure outside the container relative to the pressure inside the container.

In another series of tests, plastic containers (303×406) were filled with 8.3 ounces of green beans cut to 1¼ to 1½ inches in size. A small quantity of concentrated salt solution was added to each container and the container was filled to overflow with water at 200° F. to 205° F. Each container was topped to approximately 6/32 inch headspace and then steam flow closed with a metal end. The containers were then stacked in a still retort, metal ends down, with each stack separated from the next by a perforated divider plate. Two batches of containers (100 containers per batch) were cooked in steam at 250° F. for 13 minutes. At the conclusion of the cooking cycle air was introduced into the retort to increase the pressure from 15 p.s.i.g. to 25 p.s.i.g. and the container was then cooled by water for 5½ minutes. The retort was then vented to atmospheric pressure and cooling continued for an additional 5½ minutes. Examinations of the containers showed no rocker bottom or sidewall panelling and all the containers had acceptable configurations.

In another series of tests plastic containers (303×406) were filled with 10.2 ounce of blanched fancy peas. A small quantity of a concentrated salt solution was added to each container and the container was filled to overflow with water at 200° F. to 205° F. Each container was topped to approximately 6/32 inch headspace and then steam flow closed with a metal end. The containers were stacked in a still retort, metal ends down, in 4 layers, with 25 containers in each layer separated by a perforated divider plate. The containers were then cooked with steam at 250° F. for 19 minutes. One batch of the containers was cooled with water at the retort pressure of 15–16 p.s.i.g.. The resulting containers did not reform properly due to bottom rocker and sidewall panelling. Another batch was reformed at 25 p.s.i.g. by passing air into the retort and then cooled with cold water for approximately 6 minutes after which the retort was vented to ambient pressure and cooled for another 6 minutes. No rocker bottom or sidewall panelling was observed and all the containers in this batch had acceptable configuration.

As has been discussed a container which is subjected to a normal thermal processing cycle will bulge outwardly at the end of the heating cycle. If at that time the container were to be punctured so that the inside to outside pressure differential across the container wall would be eliminated and the container then cooled, the bulged condition would persist and the bottom would not reform. In order to reform the container, the pressure outside the container must exceed the pressure inside the container.

Figure 9:
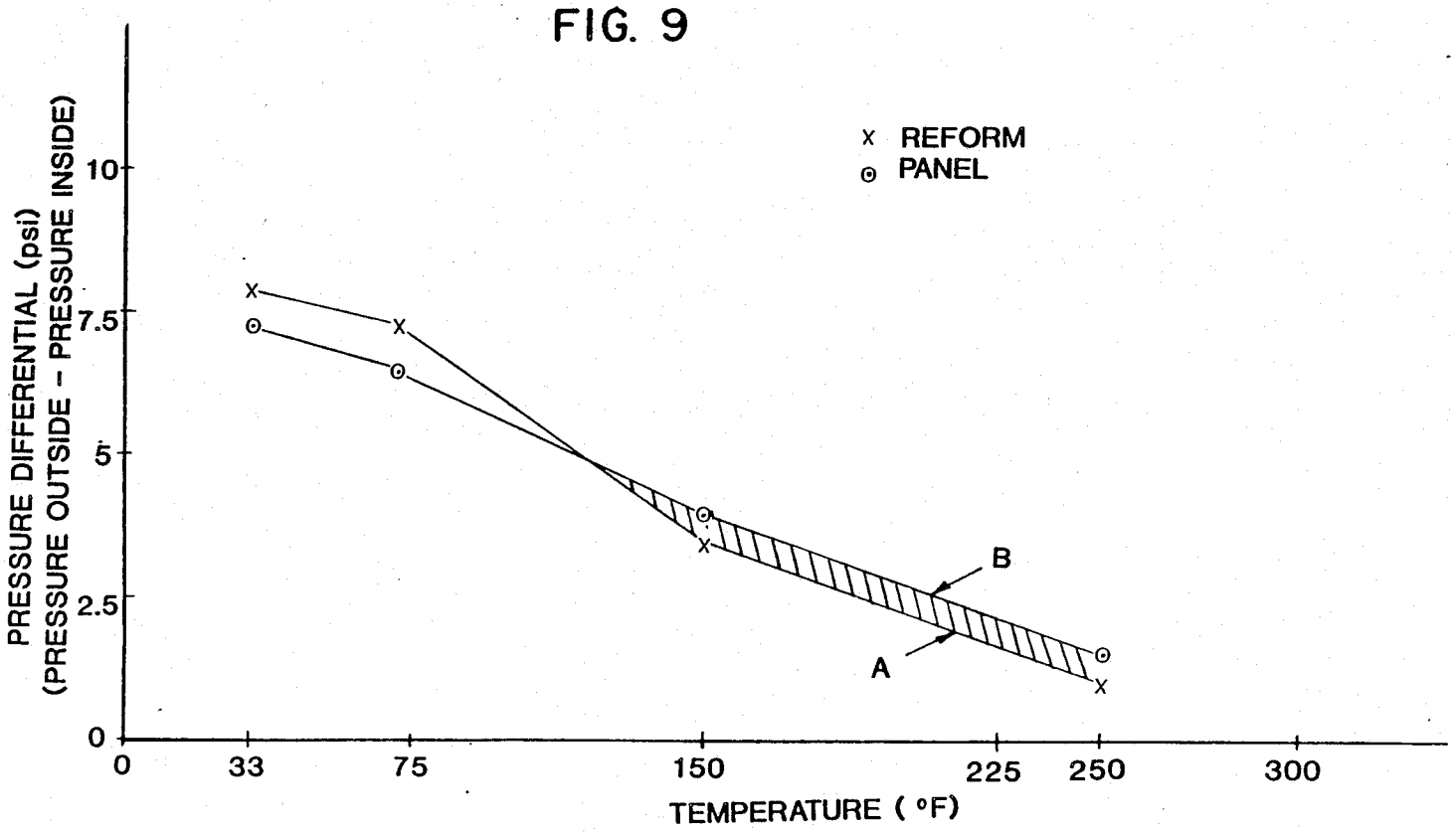
FIG. 9 is a graphical representation illustrating bottom reforming and sidewall paneling as functions of temperature and pressure.

FIG. 9 shows the pressure differential required to reform the bulged bottom wall of a particular multilayer injection blow molded container (curve A) and also the pressure differential above which the sidewall panels (curve B). This relationship is shown over the range of 33° F. to 250° F.

The data for FIG. 9 were developed by heating the container in an atmospheric hot air oven to 250° F. and subjecting it to an internal pressure of about 6 psig for a few minutes. The container temperature was then adjusted to the various temperature values shown on the graph and the internal pressure was then decreased until reform and panelling occurred and the corresponding pressure differentials were recorded.

From FIG. 9 it is noted that if the container material is 150° F. or above and a pressure differential (P outside − P inside) is applied across the container walls, the container will reform satisfactorily whereas if the container wall is at 75° F. or lower, and a pressure differential is applied it will panel at a lower pressure than is necessary to produce bottom reform. In addition it is noted that for this design, and in the 150° F. to 250° F. temperature range, there is a difference between the pressure differential required for proper reform and that which causes sidewall panelling.

It is further noted that curves "A" and "B" cross at about 112° F., indicating a temperature below which satisfactory reform can not be accomplished. In observing the containers during testing it was noted that at 150° F. or above, reforming appeared to occur gradually and proportionally with the pressure change. At 75° F. and below reform and panelling occurred abruptly.

The increase in external pressure while the plastic is warm can be readily accomplished in most still retorts by introducing air or nitrogen at the end of the steam heating cycle but before the cooling water is introduced. Although air and nitrogen are equally effective in reforming the container, the use of air could result in some undesired permeation of oxygen into the container since the oxygen barrier properties of some containers are reduced by the high temperatures and mositure conditions during retort. We have found that the introduction of such an air or nitrogen overpressure is also effective in many continuous rotary cookers.

In other cases, it is impractical to impose such an added gas overpressure, either because there is no provision for maintaining such a pressure during cooling or because the pressure limitations of the equipment are such that the pressure required for reforming exceeds the allowable equipment pressure limits. It has been found that under certain conditions, the desired reformation can be achieved even without such an externally applied pressure or with an external pressure insufficient for reformation at the internal pressures existent at the end of the heating cycle. The key to proper reformation under these restrictions is to cool gradually the container in such a manner that the plastic will still be relatively soft at the time when the container contents have cooled sufficiently to reduce the internal pressure below the external pressure. This can be accomplished with the use of relatively warm cooling water, at least during the initial stages of cooling.

In connection with the above, it has been found that under certain conditions less than the previously mentioned large overpressure of about 10 to 15 psig is sufficient to obtain successful reformation. It has been found that the retort or external pressure during cooling can be moderately higher, about the same as, or even below the retort cook pressure. This would apply whether the retort is still or continuous.

The following series of tests will further illustrate this aspect of the invention.

Several injection blow molded multi-layer plastic containers (211×215, i.e. 2 11/16 inches in diameter and 2 15/16 inches high) were filled with 135° F. water to leave a series of different headspaces, closed by a double seam with a steel end at 20 inches of vacuum and thermally processed in a still retort at 250° F. (15.3 psig equilibrium steam pressure) for 90 minutes. At the conclusion of the thermal sterilization process, air was introduced to attain an air pressure of about 15 psig. Thereafter, the container content was cooled for 12 minutes to below 165° F. with water sprayed onto the plastic end of the container while the container was resting on its metal end. Table IIA below shows that plastic containers having a headspace in the six through ten cc range when still retorted as above were successfully reformed with a pressure during cooling about the same as pressure during cooking.

TABLE IIA

| CONTAINER CONFIGURATION | |
|---|---|
| Head space Volume (cc) | After Retorting |
| 2 | Rocker |
| 2 | Rocker |
| 2 | Success |
| 2 | Success |
| 2 | Success |
| 4 | Success |
| 4 | Success |
| 4 | Success |
| 4 | Rocker |
| 4 | Rocker |
| 4 | Rocker |
| 6 | Success |
| 6 | Success |
| 6 | Success |
| 6 | Success |
| 6 | Success |
| 6 | Success |
| 8 | Success |
| 8 | Success |
| 8 | Success |
| 8 | Success |
| 8 | Success |
| 8 | Success |

TABLE IIA-continued

| CONTAINER CONFIGURATION | |
|---|---|
| Head space Volume (cc) | After Retorting |
| 10 | Success |
| 10 | Success |
| 10 | Success |
| 10 | Success |
| 10 | Success |
| 10 | Panel |
| 12 | Success |
| 12 | Kink* |
| 12 | Kink* |
| 12 | Success |
| 12 | Success |
| 12 | Success |
| 14 | Success |
| 14 | Success |
| 14 | Panel |
| 14 | Panel |
| 14 | Panel |
| 14 | Panel |

*Kink: A distortion of the bottom of the container caused by a local thin spot around one of the rings of the bottom. It is related to panelling in that it is aggravated by too much headspace and vacuum.

The retort pressure and pressure of a container processed under the conditions of Table IIA during thermal processing are shown below in Table IIB.

TABLE IIB

| Condition in Retorts | Time, minutes | Container psig | Retort psig |
|---|---|---|---|
| Mid Cook | 50 | 21.5 | 15.0 |
| End Cook | 93 | 21.0 | 15.0 |
| Cooling Before Reform | 95 | 18.5 | 14.5 |
| Container Reform | 98 | 13.0 | 14.0 |
| End of Cooling | 109 | 13.0 | 14.0 |
| Pressure Released | 110 | −0.3 | 0 |

*The successfuly reformed container whose history is shown in Table IIB had a headspace of 8 cc.

In another test, a container packed as in the previous case was thermally sterilized and cooled under "overpressure" cooling. The results are shown in Table IIC below.

TABLE IIC

| Condition in Retorts | Time, minutes | Container psig | Retort psig |
|---|---|---|---|
| Mid Cook | 55 | 15.2 | 10.5 |
| End of Cook | 109 | 15.2 | 10.5 |
| Start Overpressure | 109.5 | 21.0 | 17.0 |
| Start Water Spray | 113.5 | 20.0 | 19.5 |
| Container Reform | 118.5 | 18.0 | 19.0 |
| End Overpressure Cool | 130 | 18.0 | 19.2 |
| Pressure Released | 131 | −0.2 | 0 |

*The successfully reformed container whose history is shown in Table IIC had a headspace of 8 cc.

As shown in Table IIB, the retort pressure during the cooling cycle may be less than the retort pressure during cooking cycle. This is evident by comparing the pressure of 15.0 psig at the end of the cooking cycle with the pressure of 14.0 psig during cooling cycle (container reform). In case of "overpressure" cooling, as it is seen from FIG. IIC, the retort pressure in the cooling cycle (container reform) is 19.5 psig compared to a retort pressure of 10.6 psig at the end of the cooking cycle. This indicates that the retort pressures during cooling and reform need not be as much as 15 psig higher than the retort pressure during cooling.

In both cases, the resulting containers had acceptable container configuration.

Results similar to Table IIC were attained by packing the container with Chili and Beans instead of water. These results are shown in Table IID below.

TABLE IID

| Condition in Retorts | Time, minutes | Container psig | Retort psig |
|---|---|---|---|
| Mid Cook | 60 | 17.0 | 10.6 |
| End of Cook | 115 | 17.2 | 10.6 |
| Start overpressure | 115.5 | 19.8 | 19.5 |
| Start water spray | 119 | 21.0 | 20.8 |
| Container Reformed | 123.5 | 18.5 | 19.5 |
| End overpressure cool | 130.5 | 18.0 | 19.5 |
| Pressure released | 131 | 1.2 | 0 |

*The multi-layer plastic containers successfully reformed under the conditions shown in Table IID were 211 × 215 inches and closed with a steel end.

As shown in Table IID, the retort pressure at the end of the cook is 10.6 psig, and during cooling (container reform), the retort pressure is 19.5 psig. Once again, it is noted that this difference is less than 15 psig but the container configuration was still acceptable and had no rocker bottom or sidewall panelling.

While the above test results indicate that acceptable container configurations are readily obtainable with a still retort, acceptable container configurations are also readily attainable with a Steritort and with continuous retorts. The following test results show successful reformation of containers in a Steritort cooker/cooler.

Several injection blow molded multi-layer plastic containers (211×215) were filled with 135° F. water to leave a series of different headspaces, closed by a double seam with a steel end at 20 inches of vacuum and thermally processed in a Steritort at 250° F. (15.3 psig equilibrium steam pressure) for 30 minutes. At the conclusion of the thermal sterilization process, air was introduced to obtain an air pressure of 13.3 psig. Thereafter, the container content was cooled for 5 minutes at that air pressure by continually or intermittently submerging the containers in water during rotation of the Steritort reel on which the containers are mounted and during the rotation of the container in the water in the lower portion of the Steritort shell housing. The container content was cooled to below 165° F., were then additionally cooled to below 110° F. in the same manner but at atmospheric pressure.

Table IIE below shows that plastic containers having a headspace in the four through ten cc range when Steritort processed in the manner described above were successfully reformed with a cool pressure about 2 psig below the cook pressure.

TABLE 11E

| Headspace Volume (cc) | Container Configuration After Retorting |
|---|---|
| 2 | Success |
| 2 | Rocker |
| 2 | Success |
| 2 | Rocker |
| 2 | Success |
| 2 | Success |
| 4 | Success |
| 4 | Success |
| 4 | Success |
| 4 | Success |
| 4 | Success |
| 4 | Success |
| 6 | Success |
| 6 | Success |
| 6 | Success |
| 6 | Success |
| 6 | Success |
| 6 | Success |

TABLE 11E-continued

| Headspace Volume (cc) | Container Configuration After Retorting |
|---|---|
| 8 | Success |
| 8 | Success |
| 8 | Success |
| 8 | Success |
| 8 | Success |
| 8 | Success |
| 10 | Success |
| 10 | Success |
| 10 | Success |
| 10 | Success |
| 10 | Success |
| 10 | Panel |
| 12 | Success |
| 12 | Panel |
| 12 | Success |
| 12 | Panel |
| 12 | Success |
| 12 | Success |
| 14 | Panel |
| 14 | Panel |
| 14 | Panel |
| 14 | Panel |
| 14 | Success |
| 14 | Success |

While the above test results show plastic containers can be successfully reformed using a Steritort process, they also indicate plastic containers can be successfully reformed in continuous retorts, since it is well known that steritorts are used in laboratories to simulate, and predict performance of containers thermally processed in, commercial continuous, e.g. rotary, retorts which are well-known to respectively have appended thereto a continuous cooler.

Although the test results demonstrate successful container reformation with containers filled to within certain headspace ranges, it is to be noted that the headspace range may be different and may be wider than reported above, as discussed herein, bottom bulging, panelling and successful reformation will depend on various factors such as container size, wall thicknesses, design, and material properties, initial vacuum level in the container headspace, initial headspace, thermal expansion of the product and the container, whether the container has been pre-shrunk, and, as will be discussed in detail, the cooling process including the type employed, and especially the rate and uniformity of cooling.

In addition to achieving a condition, however obtained, during the cooling cycle wherein the pressure outside of the container (Po) is greater than the pressure inside the container (Pi) to obtain successful reformation, it has been found that the type, rate and uniformity of cooling of the container body also are very important factors to be considered for successful reformation, particularly in relation to how and when the aforementioned pressure differential will occur. These cooling factors affect the headspace range in which successful reformation can be attained, given other factors such as the container's characteristics and its contents.

As previously stated, reformation is best effected at a temperature at which the plastic is reformable. In reformation during cooling it is desirable that Pi be reduced below Po when the plastic is reformable, preferably soft. Since cooling the plastic affects its softness and reformability, the cooling factors are important. During cooling, Pi, which in the cook cycle exceeded Po, will initially be about the same as or slightly above Po.

When the container is gradually cooled, Pi drops below Po primarily because the vapor pressure in the container decreases as the contents are cooled. This pressure differential provides the driving force for container reformation. Thus, under the cooling conditions, the reformation process begins and the bottom bulge begins to reform or invert.

In certain applications the more gradual cooling rate the wider the headspace range will be. It has been found that with a still retort, the cooling rate of the plastic body may be faster, cooling is less uniform and the headspace range for reformation to acceptable configurations may be narrower, than with Steritort and continuous retorts.

In a still retort, in which water flows onto the plastic container bottom adjacent to which is any headspace, since the container is inverted and rests on the metal end which usually is its top end. Not being in direct contact with the heated contents, the plastic bottom wall cools and stiffens relatively more quickly than it does in a Steritort where the water contact is different. Cooling of the container body is less uniform than in a Steritort in the sense that the container's bottom which is in first contact with the water and is not in contact with the heated contents, cools more rapidly than the sidewall which is in direct contact with the heated contents. The above will occur in any still retort in which containers are so inverted during the thermal processing.

In a Steritort, and increasingly so for a continuous retort, cooling of the plastic is more gradual. In a Steritort, the containers are in a horizontal position on the Steritort reel and the containers are rotated about the axis of the reel and about their axes as they are repeatedly submerged in the water at the bottom portion of the shell housing. The heated contents are more uniformly mixed or agitated and more uniformly in contact with the container sidewalls and bottom wall, and the container is more uniformly cooled than in a still retort. Thus, the plastic of the container, particularly its bottom stays warmer longer, is in reformation condition longer and stiffens later. This is particularly desirable because it has been found that in any cooling cycle, it is particularly important that cooling be effected in a manner that when the internal pressure of the container drops below the pressure exterior of the container, e.g. in the cooler, the temperature of the plastic bottom not be so much cooler than that of the sidewall such that the bottom would be stiff and more stable than the side walls and the side walls would panel before the bottom reforms, sucks in or inverts. Thus, in a Steritort or continuous cooling process this condition is avoided since conditions can be such that a significant temperature differential between the bottom and sidewall temperature is avoided, and their temperatures are more uniform during cooling.

As it was previously described, the bottom bulge will not properly reform unless the relative rigidity of the bulged bottom wall is less than that of the sidewalls. This relative rigidity depends on the temperature of the plastic walls at a time when the external pressure exceeds the internal pressure.

Even if this rigidity relationship is such that the bottom does reform inwardly from its bulged position, it will not always reform far enough to form an acceptable container at the end of the cooling phase of the process. In particular, it has been found that if the initial vacuum level in the container is not sufficient, the bottom wall will not always be uniformly reformed. Thus, the bottom wall will in many cases be distended inwardly in one area of the bottom while still remaining distended outwardly in another portion, thereby producing a "rocker" bottom. Even when the more extended portion does not extend beyond the base of the sidewall so as to form a "rocker" bottom, the appearance of such an unevenly formed bottom is undesirable. This non-uniform reformation is believed to result primarily from non-uniformities in the plastic thickness as formed in the container manufacturing process.

Figure 6:
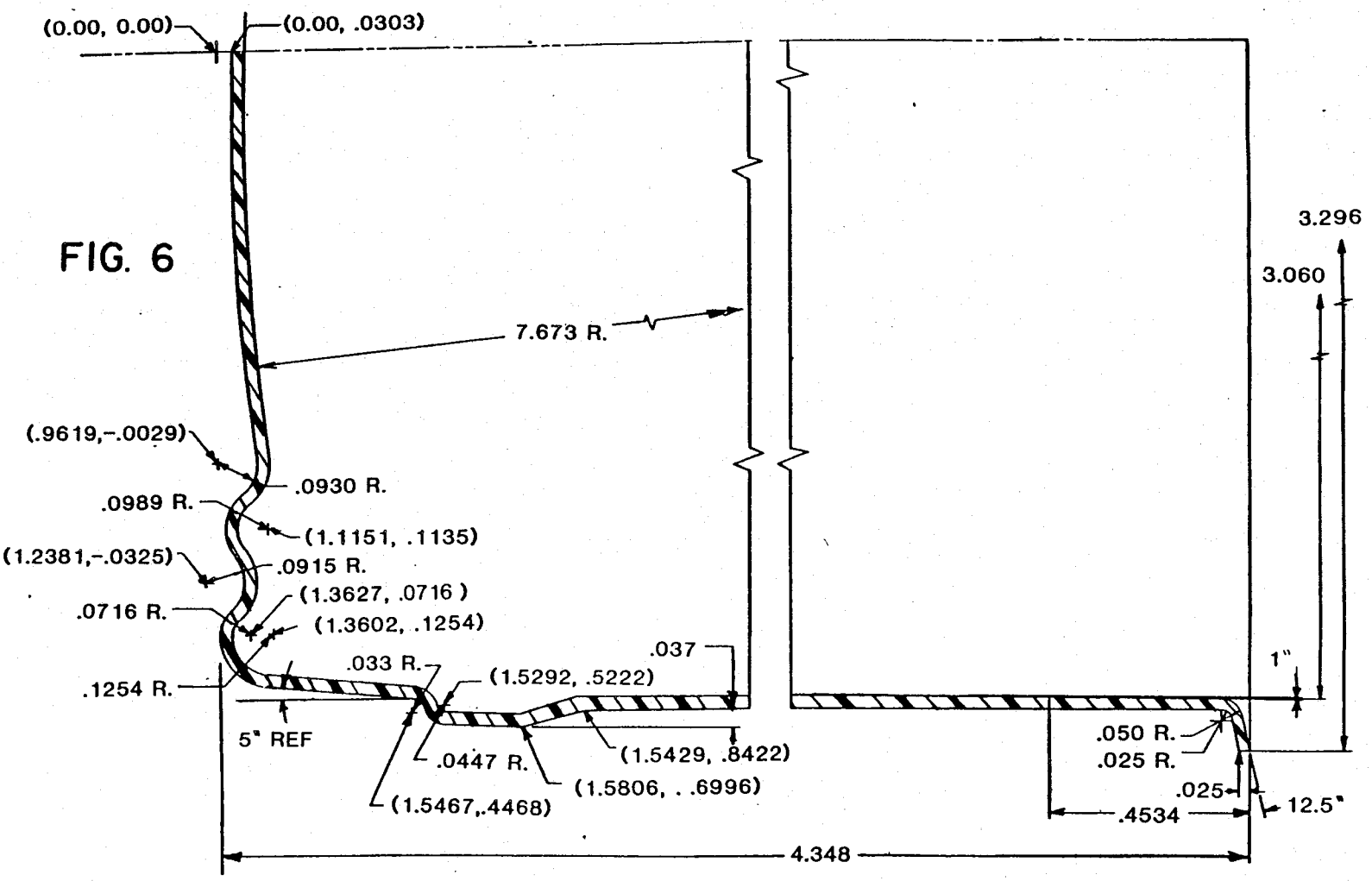
FIG. 6 is a partial elevational fragmentary sectional view of a container similar to FIG. 3 but showing the dimensions of a multi-layer injection blow molded container.
Figure 7:
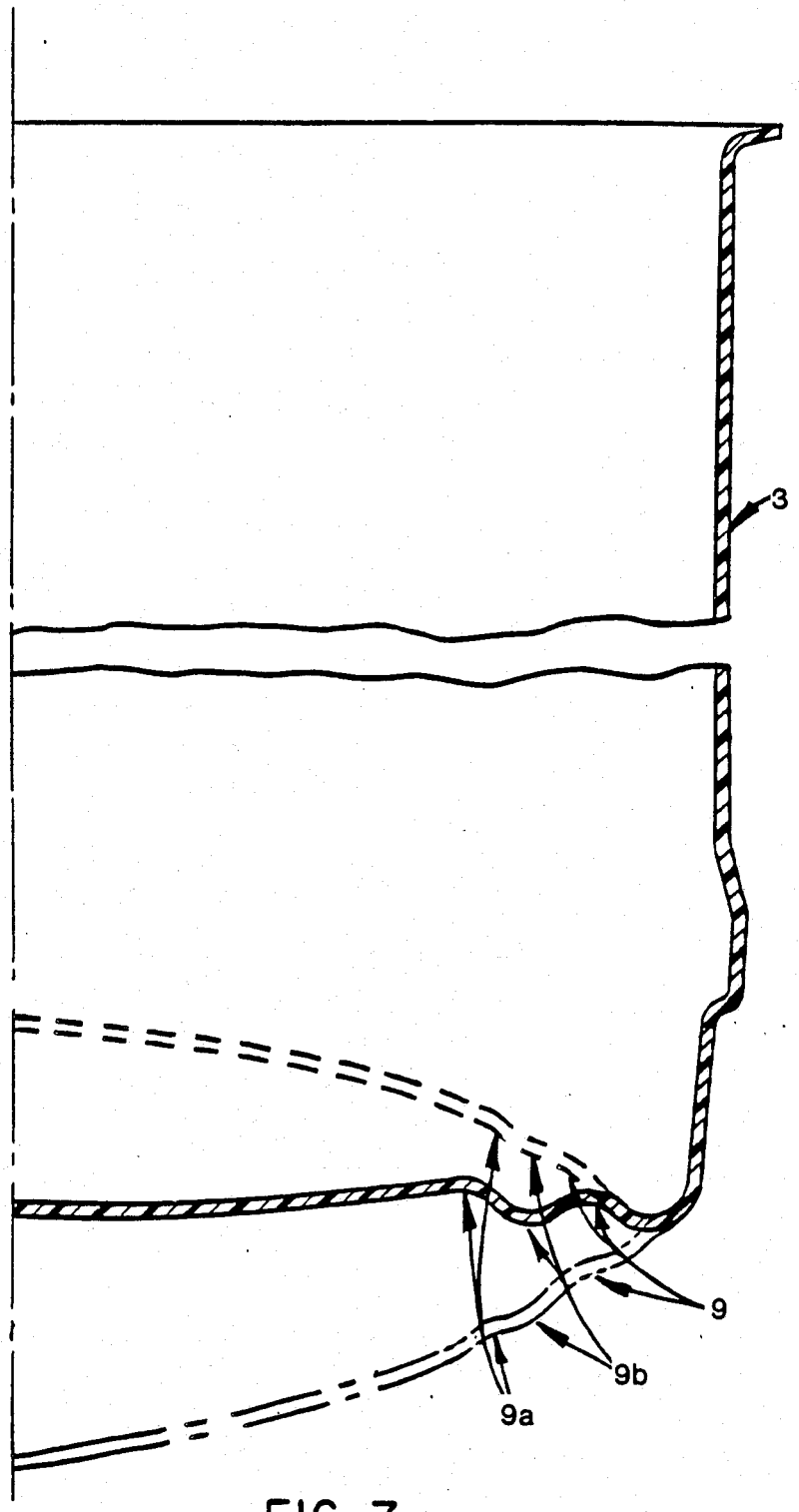
FIG. 7 is a partial elevational fragmentary sectional view of the container shown in FIG. 2 illustrating the container bottom wall in neutral, bulged and inwardly distended positions.
Figure 7A:
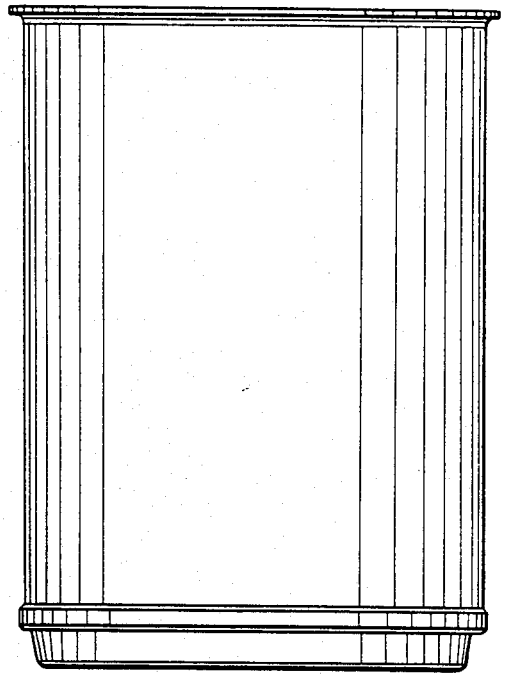
FIG. 7*a* is an elevational view of the container shown in FIG. 6.
Figure 7B:
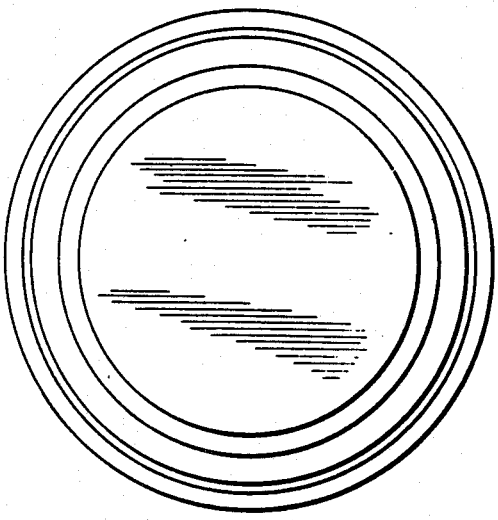
FIG. 7*b* is a bottom view of the container shown in FIG. 7*a*.

We have discovered, however, that we can produce satisfactorily uniform reformation of the bottom even with such imperfect containers by filling the containers under conditions which will result in all areas of the bottom being largely inverted. In particular, we have found that for a given fill height and hence a given initial headspace volume, there is a given minimum vacuum level required for full inversion. For a smaller initial headspace volume, the minimum vacuum level required would be greater. We have found that the proper relationship of these two variables can be defined by how much inward deflection of the bottom would be required to increase the pressure in the final headspace to nearly atmospheric. If the deflection required to compress the headspace is too low, the bottom will not fully invert and rocker bottoms can result. For the preferred container shown in FIG. 6, the headspace and initial vacuum levels should be sufficient to invert the bottom of the container by at least 14 cubic centimeters before the headspace gasses would be compressed, at room temperature, to approximately atmospheric pressure.

Figure 11:
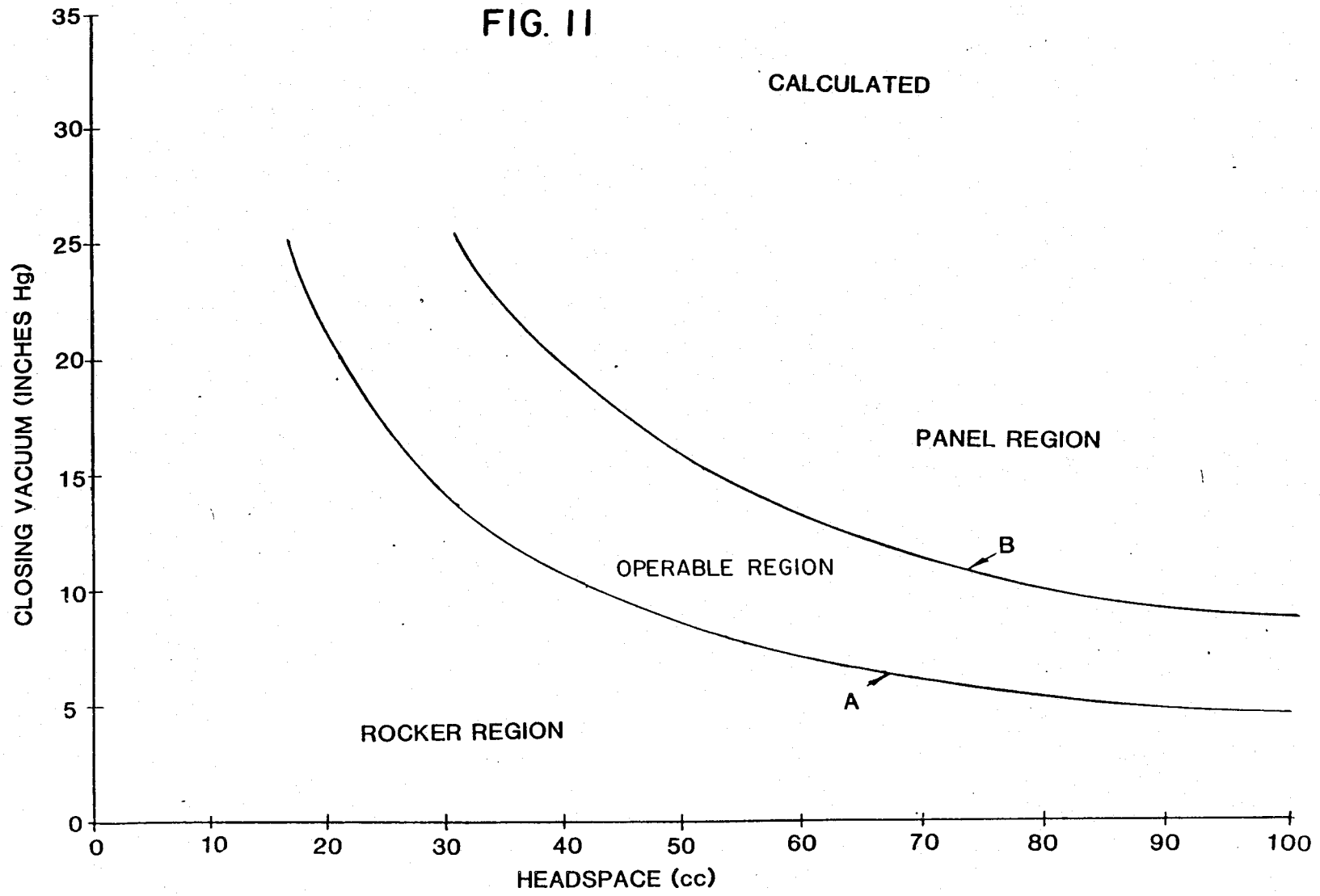
FIG. 11 is a graphical representation of calculations defining the relationship between the initial headspace of gases in the container and the sealing vacuum in the container.

It will be obvious to one skilled in the art that any gasses dissolved in the product will alter this relationship in the same way as if those dissolved gasses had been present initially in the headspace. Curve A on FIG. 11 represents the relationship between headspace and initial vacuum level in the container in cases where there are no significant amount of dissolved gasses (i.e. water) in the container content.

It will further be recognized that the initial vacuum can be generated either with a vacuum closing machine or by displacing some of the air in the headspace with steam by impinging steam into the headspace volume while placing the closure onto the container by the well known "steam flow closure" method.

If the vacuum level in the container is very high, the bottom wall will distend inwardly as long as it continues to be less resistant to deflection than is the sidewall. Once it has distended inwardly to the point where it has formed a concave dome, it will start to become more resistant to further deflection than is the sidewall. If there is still sufficient vacuum remaining at that point, the sidewall will panel giving an undesirable appearance. As in the minimum allowable vacuum level described previously, the maximum allowable vacuum level depends on the fill height. Again it has been found that the proper relationship of these two variables can be defined by how much deflection of the bottom would be required to increase the pressure in the final headspace to atmospheric. For the preferred container shown in FIG. 11, the headspace and initial vacuum levels should be sufficient to invert the bottom of the container by no more than 26 cubic centimeters. Curve B on FIG. 11 represents the relationship between these two variables for the case in which there is not a significant amount of dissolved gasses; i.e. water.

At values of initial vacuum and headspace volume falling below curve A, the containers will form rocker bottoms and at values above curve B, the containers will panel. Values falling between curves A and B are therefore desired.

The above calculated relationships correspond approximately to the experimental results for a group of containers which have been specially treated by a process of this invention known as annealing. The data on these containers are represented by the curves marked A' and B' in FIG. 10. For containers which have not been so treated, rocker bottoms are observed under conditions which would be calculated to invert acceptably. Data on these containers are represented by the curves A" and B" in the FIG. 10.

We ave found that this increased tendency to form rocker bottoms after thermal processing is the result of a shrinkage which occurs in these containers at the temperatures experienced in the food sterilization process. As a result of this shrinkage, the volume of the container after processing will be less than would otherwise be expected. Correspondingly, the amount of bottom deflection which would be required to compress the headspace to approximately atmospheric pressure is reduced and the bottom will no longer fully invert under conditions which would have achieved full inversion without such shrinkage. As will be apparent from the above discussion and from the experiment results presented below, improved container configuration after processing can be achieved by annealing or pre-shrinking the containers before filling or sealing.

The pre-shrinking of the container may be achieved by annealing the empty container at a temperature which is approximately the same, or preferably higher, than the thermal processing temperature. The temperature and time required for thermal sterilization of food will vary depending on the type of food but, generally, for most packaged foods, thermal processing is carried at a temperature of from about 190° F. (for hot-filling) to about 270° F., for a few minutes to about several hours. It is understood, of course, that this time need only to be long enough to sterilize the food to meet the commercial demands.

For each container, at any given annealing temperature, there is a corresponding annealing time beyond which no significant shrinkage in the container volume can be detected. Thus, at a given temperature, the container is annealed until no significant shrinkage in the container volume is realized upon further annealing.

In addition to pre-shrinking the container by a separate heat treatment step conducted in an oven or similar device, it is possible to achieve the same results by pre-shrinking the container as a part of the container making operation. By adjusting mold cooling times and/or mold temperatures, so that the container is hotter when removed from the mold, a container which shrinks less during thermal processing can be obtained. This is shown below for a series of 303×406 containers made by multi-layer injection blow molding in which the residence time in the blow mold was deliberately varied to show the effect of removing the container at different temperatures on the container's performance during thermal processing.

| Container | | Mold Closed | Temp. on Leaving | Shrinkage @ 250° F., 15 minutes | |
|---|---|---|---|---|---|
| Designation | Capacity-cc | Time-Sec. | Mold | cc. | % |
| 1 | 510 | 2.4 | Lowest | 10.2 | 2.0 |
| 2 | 505 | 1.2 | Intermediate | 8.5 | 1.7 |
| 3 | 498 | 0.1 | Highest | 4.4 | 0.9 |

Note that the container 3 had partially shrunk on cooling to room temperature and had less shrinkage at 250° F. than containers 1 and 2. All these containers were filled with water at a range of headspace, and a 20" closing vacuum, and retorted at 250° F. for 15 minutes to determine the range of headspace that would be used to achieve good container configuration.

| Container | High Temperature Annealing | Allowable Headspace cc |
|---|---|---|
| 1 | No | 39–40 |
| 1 | Yes | 20–40 |
| 2 | No | 25–40 |
| 2 | Yes | 18–40 |
| 3 | No | 22–40 |
| 3 | Yes | 17–40 |

Note that container #1 when unannealed had only a 1 cc range in headspace. Containers #2 and #3 without annealing had a much larger range. Of particular importance is the fact that container #3, without a separate heating step, had virtually as broad a range as container #1 had with a separate high temperature annealing step.

The amount of residual shrinkage in the container when it is filled and closed has a major effect on the range of allowable headspace and vacuum levels. When shrinkage exceeds about 1½% (at 250° F. for 15 minutes) it becomes extremely difficult to use the containers commercially unless they are deliberately pre-shrunk. The containers discussed above were made by either injection blow molding or thermoforming and had shrinkage of 1.4 and 4% respectively. There are other plastic containers being developed for thermal processed foods which have about 9% residual shrinkage and will also beenfit from this pre-shrinking invention.

These containers are the Lamicon Cup made by Toyo Seikan in Japan using a process called Solid Phase Pressure Forming, and containers made using the Scrapless Forming Process by Cincinnati Milacron who is developing this process.

Figure 10:
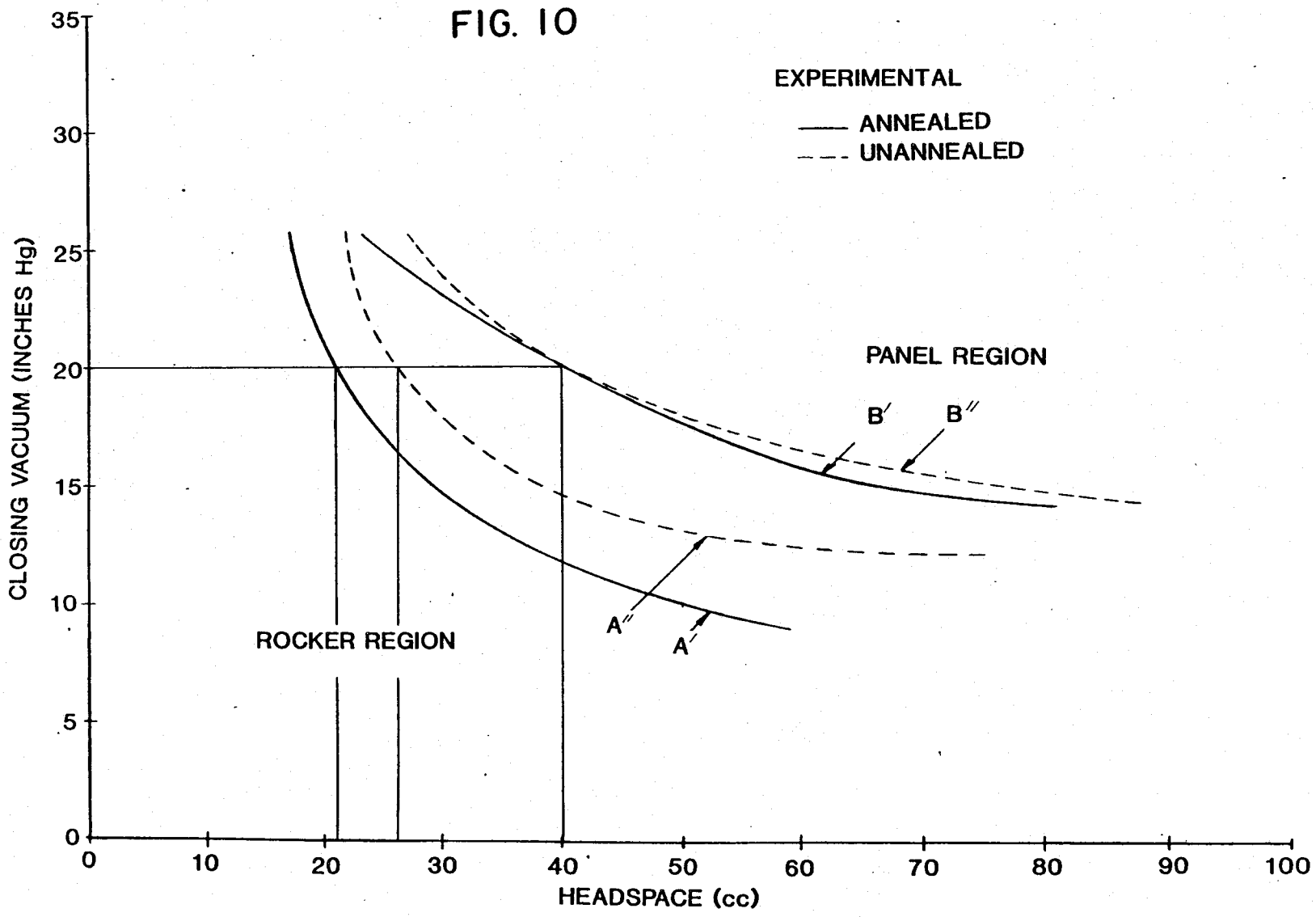
FIG. 10 is a graphic representation of experimental data illustrating the relationship between the initial headspace of gasses in the container and sealing vacuum in the container.

The advantages of using an annealed container in the process of the present invention can be further appreciated by reference to FIG. 10. As shown in this figure, the use of annealed containers increases the headspace range which may be maintained in the container at closing. Thus, for example, for a typical multi-layer injection blow molded container of 303×406, filled with 70° F. deionized water, of the container is closed at an initial sealing vacuum of 20 inches, usable headpsace which can be tolerated at reform for an unannealed container is 26–40 cc. This corresponds to a headspace range for 14 cc. If, however, the container is annealed, the usable headspace is 21–40 cc, thus increasing the headspace range to 19 cc.

The increased usable headspace range allows for less accuracy during the filling step. Since commercial filling and closing equipment are generally designed within an accuracy of ±8 cc, the annealed container will not require much modification of such equipment.

It has also been discovered that further improvements in container reformation may be realized by using a container which has been pre-shrunk prior to thermal processing. The use of pre-shrunk container permits greater range of filling conditions as will hereinafter be explained.

For each container, at any given annealing temperature, there is a corresponding time beyond which no significant shrinkage is attained in the container volume. Thus, at any given temperature, the container is annealed until no further significant shrinkage in the container volume is detected upon further annealing. Obviously, this will vary with the different resins used to make the container and the relative thicnkess of the container wall.

Instead of pre-shrinking the container by annealing as aforesaid, it is possible to use a pre-shrunk container wherein the container volume has been reduced during the container making operation. Thus, whether container is made by injection blow molding or by thermoforming, the container made may be essentially non-shrinkable since its volume had been reduced during container making operation.

The following examples will serve to further illustrate the present advantages of the use of annealed (pre-shrunk) containers.

EXAMPLE 1

Two sets of thermoformed multilayered plastic containers (303×406, i.e., 3-3/16 inches in diameter and 4-6/16 inches high) were used in this example. The first set was not annealed but the second set was annealed at 250° F. for 15 minutes in an air oven, resulting in 20 cc volume shrinkage of the container measured as follows:

A Plexiglass plate having a central hole is placed on the open end of the container and the container is filled with water until the surface of the Plexiglass plate is wetted with water. The filled container and Plexiglass plate are weighed and the weight of the empty container plus the Plexiglass plate is subtracted therefrom to obtain the weight of water. The volume of the water is then determined from the temperature and density at that temperature.

The above procedure was carried out before and after annealing of the container. The overflow volume shrinkage due to annealing was 20 cc, or 3.9 volume percent, based on a container volume of 502 cc.

Both sets of containers were filled with 75° F. deionized water and the containers were sealed by double seaming a metal end using a vacuum closing machine at 20 inches of vacuum. All containers were then retorted in a Steritort at 250° F. for 20 minutes and then cooled at 25 p.s.i. The results are shown in Table III below, wherein "Rocker" signifies that the container is unsatisfactory due to bulging in the container bottom, "Panel" designates sidewall panelling and, again, an unsatisfactory container, and "OK" indicates that the container is satisfactory because it has no significant bottom bulging or sidewall panelling.

TABLE III

| Headspace | Condition After Closing Machine | | Condition After Retorting | |
|---|---|---|---|---|
| Volume, cc | Annealed | Not Annealed | Annealed | Not Annealed |
| 16 | OK | OK | Rocker | Rocker |
| 18 | OK | OK | OK | Rocker |

TABLE III-continued

| Headspace | Condition After Closing Machine | | Condition After Retorting | |
|---|---|---|---|---|
| Volume, cc | Annealed | Not Annealed | Annealed | Not Annealed |
| 20 | OK | OK | OK | Rocker |
| 22 | OK | OK | OK | Rocker |
| 24 | OK | OK | OK | Rocker |
| 26 | OK | OK | OK | Rocker |
| 28 | OK | OK | OK | Rocker |
| 30 | OK | OK | OK | Rocker |
| 32 | OK | OK | OK | Rocker |
| 34 | Panel | Panel | OK | Rocker |
| 36 | Panel | Panel | Panel | Panel |

As shown in Table III, the annealed, and hence, pre-shrunk containers are free from bottom bulging or sidewall panelling, whereas the non-annealed containers largely fail due to rocker or panel effects. In addition, the use of annealed containers permits greater range of headspace volume as compared to the containers which are not annealed prior to thermal processing.

EXAMPLE 2

Example 1 was repeated under similar conditions except that the plastic containers used had been obtained by injection blow molding. Shrinkage due to annealing was 7.9 cc or 1.6 volume percent. The results are shown in Table IV.

TABLE IV

| Headspace | Condition After Closing Machine | | Condition After Retorting | |
|---|---|---|---|---|
| Volume, cc | Annealed | Not Annealed | Annealed | Not Annealed |
| 16 | OK | OK | Rocker | Rocker |
| 18 | OK | OK | OK | Rocker |
| 20 | OK | OK | OK | Rocker |
| 22 | OK | OK | OK | Rocker |
| 24 | OK | OK | OK | Rocker |
| 26 | OK | OK | OK | Rocker |
| 28 | OK | OK | OK | OK |
| 30 | OK | OK | OK | OK |
| 32 | OK | OK | OK | OK |
| 34 | Panel | Panel | OK | OK |
| 36 | Panel | Panel | Panel | Panel |

The results in this example also illustrate the advantages which result from annealing of the containers prior to retorting.

EXAMPLE 3

This example was similar to Example 1 except that retorting was carried out at 212° F. for 20 minutes. As shown in Table V, similar results were obtained as in the previous examples.

TABLE V

| Headspace | Condition After Closing Machine | | Condition After Retorting | |
|---|---|---|---|---|
| Volume, cc | Annealed | Not Annealed | Annealed | Not Annealed |
| 15 | OK | OK | Rocker | Rocker |
| 16 | OK | OK | Rocker | Rocker |
| 17 | OK | OK | OK | Rocker |
| 18 | OK | OK | OK | Rocker |
| 19 | OK | OK | OK | Rocker |
| 20 | OK | OK | OK | Rocker |
| 21 | OK | OK | OK | Rocker |
| 22 | OK | OK | OK | Rocker |
| 23 | OK | OK | OK | Rocker |
| 24 | OK | OK | OK | Rocker |
| 25 | OK | OK | OK | Rocker |
| 26 | OK | OK | OK | Rocker |
| 27 | OK | OK | OK | Rocker |
| 28 | OK | OK | OK | Rocker |

TABLE V-continued

| Headspace Volume, cc | Condition After Closing Machine | | Condition After Retorting | |
|---|---|---|---|---|
| | Annealed | Not Annealed | Annealed | Not Annealed |
| 29 | OK | OK | OK | Rocker |
| 30 | OK | OK | OK | Rocker |
| 31 | OK | OK | OK | Rocker |
| 32 | OK | OK | OK | Rocker |
| 33 | OK | OK | OK | Rocker |
| 34 | Panel | Panel | OK | OK |
| 35 | Panel | Panel | Panel | Panel |

EXAMPLE 4

The procedure of Example 3 was repeated except that the containers had been obtained by injection blow molding. Table VI shows the same type of advantageous results as in the previous examples.

TABLE VI

| Headspace Volume, cc | Condition After Closing Machine | | Condition After Retorting | |
|---|---|---|---|---|
| | Annealed | Not Annealed | Annealed | Not Annealed |
| 15 | OK | OK | Rocker | Rocker |
| 17 | OK | OK | Rocker | Rocker |
| 19 | OK | OK | Rocker | Rocker |
| 21 | OK | OK | OK | Rocker |
| 23 | OK | OK | OK | Rocker |
| 25 | OK | OK | OK | Rocker |
| 27 | OK | OK | OK | OK |
| 29 | OK | OK | OK | OK |
| 31 | OK | OK | OK | OK |
| 33 | Panel | Panel | OK | OK |
| 35 | Panel | Panel | Panel | Panel |

The increased usable headspace range allows for less accuracy in the filling steps. Since commercial filling and closing equipment are generally designed within an accuracy of ±8 cc, the annealed container will not require much modification of such equipment.

In the foregoing examples the advantages of preshrinking of the container by annealing are illustrated utilizing containers filled with water because of experimental simplicity. These advantages can also be realized, however, in other cases where the container is filled with fruits, vegetable or other edible products. For example, injection blow molded multilayer plastic containers (303×406) were filled with fresh pears and syrup (130° F., 20% sugar solution) and retorted at 212° F. for 20 miutes. Prior to filling, a set of the containers was annealed at 250° F. for 15 minutes, while the other set was not annealed. When 7500 containers were annealed prior to retorting, the success rate was as high as 95 percent, with only about 5 percent reform failure. In the case of non-annealed containers, the success rate was considerably less since reform failures were observed in most retorted containers.

What is claimed is:

1. A method of thermal sterilization of a plastic container packed with food to obtain a thermally sterilized packed container having an acceptable configuration, which comprises filling the container with good, sealing the container, either or both of these steps including selecting an initial headspace volume and an amount of gas, taking into account an initial vacuum level, if any, at sealing such as to permit bulging and subsequent reformation of the container bottom wall without significant side wall panelling, thermally sterilizing the packed container in a retort operated at a temperature and pressure for a time sufficient to sterilize the container and its contents and to cause bulging of the container bottom wall, cooling the container and its contents, and, during the cooling step, reforming the bulged container bottom wall to attain an acceptable container configuration by controlling the pressure external of the container and the cooling conditions said controlling step including providing that said pressure is about the same as or less than that employed during the sterilizing step, providing that the plastic of the bulged container bottom wall is at a reformable temperature at which the plastic is soft while providing a pressure differential such that the ambient pressure external of the container exceeds the pressure internal the container, and utilizing the ambient pressure while said plastic is soft to reform the bulged bottom wall.

2. The method of claim 1 wherein, during reforming, the temperature of the container side wall and the temperature of the container bottom wall are such that the bottom wall reforms before the side wall panels.

3. The method of claim 1 wherein, during cooling and reforming, a significant temperature differential between the container side wall and container bottom wall is avoided.

4. The method of claim 1 wherein cooling is effected in a continuous cooler and the controlling step includes establishing a preselected air pressure prior to, at or during the initial stages of cooling, providing a rate of cooling such that as the container contents cool and pressure and volume internal the container decrease, reforming occurs prior to side wall pannelling while the plastic of the bottom wall is at a reformable temperature at which the plastic is soft.

5. A method of thermal sterilization of a plastic container packed with food to obtain a thermally sterilized packed container having an acceptable configuration, which comprises filling the container with food, sealing the container, either or both of these steps including selecting an initial headspace volume and an amount of gas, taking into account an initial vacuum level, if any, at sealing such as to permit reformation of the container bottom wall without significant side wall panelling, thermally sterilizing the packed container in a retort operated at a temperature and pressure for a time sufficient to sterilize the container and its contents and to cause bulging of the container bottom wall, cooling the container and its contents, and, during the cooling step, reforming the bulged container bottom wall to attain an acceptable container configuration by controlling the pressure external of the container and the cooling conditions, said reforming step being effected in the retort at the same or about the same pressure as that employed during the sterilization step, said controlling step including providing that the plastic of the bottom wall of the container is at a reformable temperature at which the plastic is soft while providing a pressure differential such that the pressure external of the container exceeds the pressure internal the container.

6. The method of claim 5 wherein, during reforming, the temperature of the container side wall and the temperature of the container bottom wall are such that the bottom wall reforms before the side wall panels.

7. The method of claim 5 wherein, during cooling and reforming, a significant temperature differential between the container side wall and container bottom wall is avoided.

8. A method of thermal sterilization of a plastic container packed with good to obtain a thermally sterilized packed container with an acceptable configuration, which comprises filling the container with food, sealing the container, either or both of these steps including selecting an initial headspace volume and an amount of gas, taking into account an initial vacuum level, if any, at sealing such as to permit reformation of the container bottom wall without significant side wall panelling, thermally sterilizing the packed container in a retort operated at a temperature and pressure for a time sufficient to sterilize the container and its contents and to cause bulging of the container bottom wall, cooling the container and its contents, and, during the cooling step, reforming the bulged container bottom wall to attain an acceptable container configuration by controlling the pressure external of the container and the cooling conditions, said reforming step being effected in the retort at a pressure moderately or slightly higher than that employed during the sterilizing step.

9. The method of claim 8 wherein, during reforming, the temperature of the container side wall and the temperature of the container bottom wall are such that the bottom wall reforms before the side wall panels.

10. The method of claim 18 wherein, during cooling and reforming, a significant temperature different between the container side wall and container bottom wall is avoided.

11. A method of thermal sterilization of a plastic container packed with food to obtain a thermally sterilized packed container with an acceptable configuration, which comprises filling the container with food, sealing the container, either or both of these steps including selecting an initial headspace volume and an amount of gas, taking into account an initial vacuum level, if any at sealing such as to permit reformation of the container bottom wall without significant side wall panelling, thermally sterilizing the packed container in a retort operated at a temperature and pressure for a time sufficient to sterilize the container and its contents and to cause bulging of the container bottom wall, cooling the container and its contents, and, during the cooling step, reforming the bulged container bottom wall to attain an acceptable container configuration by controlling the pressure external of the container and the cooling conditions, said reforming step being effected in the retort at a pressure which is less than that employed during the sterilizing step, said controlling step including providing that the plastic of the bottom wall of the container is at a reformable temperature at which the plastic is soft while providing a pressure differential such that the pressure external of the container exceeds the pressure internal the container.

12. The method of claim 11 wherein, during reforming, the temperature of the container side wall and the temperature of the continer bottom wall are such that the bottom wall reforms before the side wall panels.

13. The method of claim 11 wherein, during reforming, the container side wall and container bottom wall are at about the same temperature.

14. The method of claim 11 wherein, during cooling and reforming, a significant temperature differential between the container side wall and container bottom wall is avoided.

15. A method of thermal sterilization of a plastic container packed with food to obtain a thermally sterilized packed container with an acceptable configuration, which comprises filling the container with food, sealing the container, either or both these steps including selecting an initial headspace volume and an amount of gas, taking into account an initial vacuum level, if any, at sealing, such as to permit reformation of the container bottom wall without significant side wall panelling, filling the container with food at a temperature, sealing the container, thermally sterilizing the packed container in a continuous retort operated at a temperature and pressure for a time sufficient to sterilize the container and its contents and to cause bulging of the container bottom wall, cooling the container and its contents, and during the cooling step, reforming the bulged container bottom wall to attain an acceptable container configuration by controlling the pressure external of the container and the cooling conditions, said reforming step being effected in a continuous cooler at a pressure which is less than that employed during the sterilizing step, said controlling step including providing that the plastic of the bottom wall of the container is at a reformable temperature at which the plastic is soft while providing a pressure differential such that the pressure external of the container exceeds the pressure internal the container.

16. The method of claim 15 wherein, during reforming, the temperature of the container side wall and the temperature of the container bottom wall are such that the bottom wall reforms before the side wall panels.

17. The method of claim 15 wherein, during reforming, the side wall and container bottom wall are at about the same temperature.

18. The method of claim 15 wherein, during cooling and reforming, a significant temperature differential between the container side wall and container bottom wall is avoided.

19. The method of claim 15 wherein the controlling step includes establishing a preselected air pressure prior to, at or during the initial stages of cooling, providing a rate of cooling such that as the container contents cool and the pressure and volume internal the container decrease, reforming occurs prior to side wall pannelling while the plastic of the bottom wall is at a reformable temperature at which the plastic is soft.

20. The method of claim 15 wherein the pressure external of the container is the ambient pressure in the continuous cooler.

21. The method of claim 1, 5, 8, 11, 2, or 6, wherein the method is effected in a still retort.

22. The method of claim 1, 8 or 2 wherein, during reforming, the pressure exceeds the pressure during sterilization by from about 8 psig to 10 psig.

23. The method of claim 1, 15, 13 or 17 wherein the cooling step is effected gradually.

24. The method of claim 21 wherein the cooling step is effected gradually.

25. The method of claim 11, 15 or 23 wherein, during reforming, the pressure in the retort is from about 1 to about 2 psig less than the pressure during sterilizing.

26. The method of claim 1, 5, 8, 11 or 24 wherein reforming is initiated by subjecting the container to a gas pressure and then is further effected by contacting the container with water.

27. The method of claim 1, 5, 8, 11 or 15, wherein the controlling of cooling conditions includes controlling the rate of cooling.

28. The method of claim 1, 5, 8, 11 or 15 wherein the cooling conditions includes the cooling temperature.

29. The method of claim 24, wherein the cooling conditions includes the cooling temperature.

30. The method of claim 1, 5, 8, 11 or 15, wherein the controlling of cooling conditions takes into account the temperature of the plastic of the container.

31. The method of claim 27, wherein the controlling of cooling conditions takes into account the temperature of the plastic of the container.

32. The method of claim 28, wherein the controlling of cooling conditions takes into account the temperature of the plastic of the container.

33. The method of claim 29, wherein the controlling of cooling conditions takes into account the temperature of the plastic of the container.

34. The method of claim 8 or 15 wherein said controlling step including providing that the plastic of the bottom wall of the container is at a reformable temperature at which the plastic is soft, while providing a pressure differential such that the pressure external of the container exceeds the pressure internal the container.

35. The method of claim 5, 8 or 11 wherein the pressure external of the container is the ambient pressure in the retort and the ambient pressure is utilized for reforming the container bottom wall.

36. The method of claim 21 wherein the retort has an environment which includes steam.

37. A method of thermal sterilization of a container which has a plastic end wall and is packed with food to obtain a thermally sterilized packed container having an acceptable configuration, which comprises filling the container with food, sealing the container, either or both of these steps including selecting an initial headspace volume and an amount of gas, taking into account an initial vacuum level, if any, at sealing such as to permit bulging and subsequent reformation of the container end wall without significant side wall panelling, thermally sterilizing the packed container in a retort operated at a temperature and pressure for a time sufficient to sterilize the container and its contents, and to cause bulging of the container end wall, cooling the container and its contents, and, during the cooling step, reforming the bulged container end wall to attain an acceptable container configuration by controlling the ambient pressure external of the container and the cooling conditions, and utilizing the ambient pressure external of the container at a level which is about the same as or less than that employed during thermal sterilization to reform the container end wall while providing that the plastic of the bulge is at a reformable temperature at which the plastic is soft.

38. The method of claim 37 wherein the container is comprised of plastic.

39. The method of claim 38 wherein the end wall is the container bottom wall.

40. A method of thermal sterilization of a plastic container packed with food to obtain a thermally sterilized packed container having an acceptable configuration, which comprises filling the container with food, sealing the container, either or both of these steps including selecting an initial headspace volume and an amount of gas, taking into account an initial vacuum level, if any, at sealing such as to permit reformation of the container bottom wall without significant side wall panelling, thermally sterilizing the packed container in a retort operated at a temperature and pressure for a time sufficient to sterilize the container and its contents and to cause bulging of the container bottom wall, cooling the container and its contents, and, during the cooling step, reforming the bulged container bottom wall to attain an acceptable container configuration by establishing a preselected ambient gas pressure in the retort at the conclusion of thermally sterilizing, and controlling the ambient pressure and the cooling conditions, said reforming step being effected in the retort at the same or about the same pressure as that employed during the sterilization step, said controlling step including effecting cooling gradually such that as the pressure internal the container decreases, reforming occurs when the plastic of the bottom wall is at a reformable temperature at which the plastic is soft.

41. A method of thermal sterilization of a plastic container packed with food to obtain a thermally sterilized packed container having an acceptable configuration, which comprises filling the container with food, sealing the container, either or both of these steps including selecting an initial headspace volume and an amount of gas, taking into account an initial vacuum level, if any, at sealing such as to permit reformation of the container bottom wall without significant side wall panelling, thermally sterilizing the packed container in a retort operated at a temperature and pressure for a time sufficient to sterilize the container and its contents and to cause bulging of the container bottom wall, cooling the container and its contents, and, during the cooling step, reforming the bulged container bottom wall to attain an acceptable container configuration by establishing a preselected ambient gas pressure in the retort at the conclusion of thermally sterilizing, and controlling the ambient pressure and the cooling conditions, said reforming step being effected in the retort at a pressure moderately or slightly higher than that employed during the sterilization step, said controlling step including effecting cooling gradually such that as the pressure internal the container decreases, reforming occurs when the plastic of the bottom wall is at a reformable temperature at which the plastic is soft.

42. A method of thermal sterilization of a plastic container packed with food to obtain a thermally sterilized packed container having an acceptable configuration, which comprises filling the container with food, sealing the container, either or both of these steps including selecting an initial headspace volume and an amount of gas, taking into account an initial vacuum level, if any, at sealing such as to permit reformation of the container bottom wall without significant side wall panelling, thermally sterilizing the packed container in a retort operated at a temperature and pressure for a time sufficient to sterilize the container and its contents and to cause bulging of the container bottom wall, cooling the container and its contents, and, during the cooling step, reforming the bulged container bottom wall to attain an acceptable container configuration by establishing a preselected ambient gas pressure in the retort at the conclusion of thermally sterilizing, and controlling the ambient pressure and the cooling conditions, said reforming step being effected in the retort at a pressure which is less than that employed during the sterilization step, said controlling step including effecting cooling gradually such that as the pressure internal the container decreases, reforming occurs when the plastic of the bottom wall is at a reformable temperature at which the plastic is soft.

43. A method of thermal sterilization of a plastic container packed with food to obtain a thermally sterilized packed container having an acceptable configuration, which comprises filling the container with food, sealing the container, either or both of these steps including selecting an initial headspace volume and an amount of gas, taking into account an initial vacuum level, if any, at sealing such as to permit reformation of the container bottom wall without significant side wall panelling, thermally sterilizing the packed container in a retort operated at a temperature and pressure for a time sufficient to sterilize the container and its contents and to cause bulging of the container bottom wall, cooling the container and its contents in a continuous cooler, and, during the cooling step, reforming the bulged container bottom wall to attain an acceptable container configuration by establishing a preselected ambient air pressure in the continuous cooler prior to the initial stages of cooling, and controlling the ambient pressure and the cooling conditions, said reforming step being effected in the continuous cooler at an ambient pressure which is less than that employed during the sterilizing step, said controlling step including providing a gradual rate of cooling such that as the container contents cool and the pressure and volume internal the container decrease, reforming occurs prior to sidewall panelling when the plastic of the bottom wall is at a reformable temperature at which the plastic is soft.

44. A method of thermal sterilization of a plastic container packed with food to obtain a thermally sterilized packed container having an acceptable configuration, which comprises filling the container with food, sealing the container, either or both of these steps including selecting an initial headspace volume and an amount of gas, taking into account an initial vacuum level, if any, at sealing such as to permit reformation of the container bottom wall without significant side wall panelling, thermally sterilizing the packed container in a retort operated at a temperature and pressure for a time sufficient to sterilize the container and its contents and to cause bulging of the container bottom wall, cooling the container and its contents in a continuous cooler, and, during the cooling step, reforming the bulged container bottom wall to attain an acceptable container configuration by establishing a preselected ambient air pressure in the continuous cooler prior to the initial stages of cooling, and controlling the ambient pressure and the cooling conditions, said reforming step being effected in the continuous cooler at an ambient pressure which is about the same as that employed during the sterilizing step, said controlling step including providing a gradual rate of cooling such that as the container contents cool and the pressure and volume internal the container decrease, reforming occurs prior to sidewall panelling when the plastic of the bottom wall is at a reformable temperature at which the plastic is soft.

45. A method of thermal sterilization of a plastic container packed with food to obtain a thermally sterilized packed container having an acceptable configuration, which comprises filling the container with food, sealing the container, either or both of these steps including selecting an initial headspace volume and an amount of gas, taking into account an initial vacuum level, if any, at sealing such as to permit bulging and subsequent reformation of the container bottom wall without significant side wall panelling, thermally sterilizing the packed container in a retort operated at a temperature and pressure for a time sufficient to sterilize the container and its contents and to cause bulging and creep of plastic of the container bottom wall, cooling the container and its contents, and, during the cooling step, reforming the bulged container bottom wall to attain an acceptable container configuration by controlling the pressure external of the container and the cooling conditions said controlling step including providing that the pressure is about the same as or less than that employed during the sterilizing step, providing that the plastic of the bulged container bottom wall is warm while providing a pressure differential such that the ambient pressure external of the container exceeds the pressure internal the container, and utilizing the ambient pressure while said plastic is warm to reform the bulged bottom wall.

46. The method of claim 1, 5, 8, 11, 15, 40, 41, 42, 43, 44 or 45 wherein the method includes selecting as the container to be thermally sterilized, one whose wall has portions of less stress resistance relative to other portions of less stress resistance relative to other portions of the wall and relative to the sidewall to allow controlled bulging of the wall during thermal sterilization.

47. The method of claim 46 wherein the selecting step includes selecting a container whose bulged bottom wall would have approximately the same surface area as would a spherical cap whose volume is the same as that of the unbulged volume of the bottom of the container plus the desired volume increase, wherein the volume (V) is determined by $V=1/6\pi h(3a^2+h^2)$ where "h" is the dome of the spherical cap, and "a" is the radius of the container at the intersection of the sidewall and bottom wall of the container, the surface of the spherical cap can be calculated as follows:

$$S_2=4/3\pi(a^2+h^2)$$

where $S_2$ is the surface area of the spherical cap, and "a" and "h" are as defined above, and wherein the ratio of the "h" dimension to the "a" dimesion is expressed as:

$$k=h/a$$

or $$h=ka$$

where "h" and "a" are as defined above, and k is about 0.47.

48. The method of claim 47 wherein the selecting step includes selecting a container whose bottom wall in its unbulged state has a folded portion whose surface area is "$S_1$", wherein "$S_1$" equals "$S_2$".

49. The method of claim 1 or 45 wherein cooling is effected in a retort or cooler.

50. The method of claim 1, 5, 8, 11, 15, 37, 40, 41, 42, 43 or 44 wherein the sterilizing step includes causing creep of plastic of the container bottom wall.

51. The method of claim 1, 5, 8, 11, 37, 40, 41, 42 or 44, wherein at the conclusion of thermally sterilizing, there is included the step of introducing air into the retort to increase the pressure to an amount moderately or slightly greater than what it was during the thermally sterilizing step.

52. The method of claim 15 or 43, wherein at the conclusion of thermally sterilizing, there is included the step of introducing air into the retort to maintain the pressure at an amount about the same or less than what it was during the thermally sterilizing step.

53. The method of claim 51 wherein the method includes continuing the air introducing step for a period of time during cooling to maintain the pressure during cooling by an amount and for a time sufficient to prevent the container bottom wall from bulging excessively such that it would no longer be reformable to an acceptable configuration.

54. The method of claim 52 wherein the method includes continuing the air introducing step for a period of time during cooling to maintain the pressure during cooling by an amount and for a time sufficient to prevent the container bottom wall from bulging excessively such that it would no longer be reformable to an acceptable configuration.

55. The method of claim 51 wherein the cooling step is effected by introducing water into the retort.

56. The method of claim 52 wherein the cooling step is effected by introducing water into the retort.

57. The method of claim 51 wherein the cooling step is effected by introducing water into the retort.

58. The method of claim 54 wherein the cooling step is effected by introducing water into the retort.

59. The method of claim 37, 40, 41, 42 or 44 wherein the retort is a still retort.

60. The method of claim 51 wherein the air introducing step is effected prior to cooling.

61. The method of claim 53 wherein the air introducing step is effected prior to cooling.

62. The method of claim 1, 5, 8, 11, 15, 37, 40, 41, 42, 43 or 44 wherein the selecting step is effected to provide a full inversion of the container bottom wall upon reformation.

63. The method of claim 15 or 43 wherein the cooling step is effected gradually by contacting the containers with relatively warm cooling water in the continuous cooler at least during the initial stages of cooling.

64. The method of claim 1 or 45 wherein the cooling step is effected gradually by contacting the containers with relatively warm cooling water at least during the initial stages of cooling.

65. The method of claim 51 wherein the retort has an environment which includes steam.

66. The method of claim 53 wherein the retort has an environment which includes steam.

67. The method of claim 37, 40, 41, 42, 43, 44 or 45 wherein the reforming step includes utilizing the ambient pressure external the container for reforming the container bottom wall.

68. The method of claim 5, 8, 11, 15, 37, 40, 41, 42, 43, 44 or 45 wherein there is included the step of pre-shrinking the plastic container and utilizing the pre-shrunk plastic container throughout the rest of the steps of the method.

* * * * *